US010377559B1

(12) United States Patent
Boomsma

(10) Patent No.: US 10,377,559 B1
(45) Date of Patent: Aug. 13, 2019

(54) HOLDER FOR A SQUEEZE POUCH

(71) Applicant: Leah Ceee O. Boomsma, Lakeville, MN (US)

(72) Inventor: Leah Ceee O. Boomsma, Lakeville, MN (US)

( * ) Notice: Subject to any disclaimer, the term of this patent is extended or adjusted under 35 U.S.C. 154(b) by 0 days.

(21) Appl. No.: 14/566,090

(22) Filed: Dec. 10, 2014

Related U.S. Application Data

(60) Provisional application No. 61/914,175, filed on Dec. 10, 2013.

(51) Int. Cl.

| | |
|---|---|
| ***B65D 85/14*** | (2006.01) |
| ***B65D 77/06*** | (2006.01) |
| ***B65D 25/28*** | (2006.01) |
| ***B65D 25/10*** | (2006.01) |
| ***B65D 43/02*** | (2006.01) |
| ***A47G 23/02*** | (2006.01) |
| ***B65D 35/56*** | (2006.01) |

(52) U.S. Cl.
CPC ..... *B65D 85/14* (2013.01); *A47G 23/0258* (2013.01); *B65D 25/10* (2013.01); *B65D 25/2805* (2013.01); *B65D 35/565* (2013.01); *B65D 43/02* (2013.01); *B65D 77/06* (2013.01); *B65D 77/065* (2013.01)

(58) Field of Classification Search
CPC ... A61J 9/06; B67D 2001/0827; B65D 35/56; B65D 35/565; B65D 77/0473; B65D 77/06; B65D 77/065; B65D 77/067; B65D 77/068; B65D 85/08; B65D 85/14; A47G 23/0241; A47G 23/0258
See application file for complete search history.

(56) References Cited

U.S. PATENT DOCUMENTS 1,951,831 A * 3/1934 Lewis ..... B65D 5/5059 206/277
2,622,420 A 12/1952 Rice
(Continued)

FOREIGN PATENT DOCUMENTS

CA 2428592 5/2002
CA 2761952 11/2010
(Continued)

OTHER PUBLICATIONS

"Fisher-Price Tote Along Pouch Feeder," Web page <http://www.amazon.com/Fisher-Price-Tote-Along-Pouch-Feeder/dp/B00BV0EUS6>, 3 pages, Jul. 21, 2013, retrieved from Internet Archive Wayback Machine <http://web.archive.org/web/20130721014451/http://www.amazon.com/Fisher-Price-Tote-Along-Pouch-Feeder/dp/B00BV0EUS6>on Mar. 31, 2015.
(Continued)

*Primary Examiner* — Mollie Impink
(74) *Attorney, Agent, or Firm* — Briggs and Morgan, P.A.; Audrey J. Babcock

(57) ABSTRACT

A holder for a squeeze pouch containing food or beverages is described. The holder may have a one-piece construction, or the holder may include both a housing and a detachable top wall or lid. The top wall or lid of the holder includes a slot adapted to receive and secure the spout of a squeeze pouch. The housing protects the flexible portion of the squeeze pouch from pressure that could cause food or beverages to exit the spout of the squeeze pouch.

19 Claims, 23 Drawing Sheets

(56) References Cited

U.S. PATENT DOCUMENTS

| | | | | | |
|---|---|---|---|---|---|
| 3,212,681 | A * | 10/1965 | Weikert | B65D 25/38 | 222/153.08 |
| 3,964,636 | A * | 6/1976 | Rehrig | B65D 77/06 | 206/509 |
| 4,533,057 | A | 8/1985 | Klittich | | |
| 4,865,208 | A * | 9/1989 | Lax | A47G 23/0241 | 215/396 |
| D318,017 | S | 7/1991 | Patterson | | |
| D321,885 | S | 11/1991 | Sheldrake | | |
| D324,176 | S | 2/1992 | Patterson | | |
| 5,110,000 | A * | 5/1992 | Nichols | B65D 77/0466 | 206/386 |
| D327,431 | S | 6/1992 | Farricielli | | |
| 5,150,811 | A | 9/1992 | Kelston | | |
| 5,405,030 | A | 4/1995 | Frazier | | |
| 5,454,483 | A * | 10/1995 | Ichikawa | A47G 23/0258 | 220/495.01 |
| 5,579,945 | A * | 12/1996 | Ichikawa | A47G 23/0258 | 220/495.06 |
| D379,711 | S | 6/1997 | Fitzgerald | | |
| 5,640,992 | A | 6/1997 | Huang | | |
| 5,702,020 | A | 12/1997 | Larsen | | |
| D402,192 | S | 12/1998 | Bell | | |
| 5,899,354 | A | 5/1999 | Garcia | | |
| 5,950,857 | A | 9/1999 | Rosen | | |
| 6,086,240 | A | 7/2000 | Murphy | | |
| D433,143 | S | 10/2000 | Chomik | | |
| 6,142,344 | A | 11/2000 | Kai | | |
| D453,095 | S | 1/2002 | Bailey | | |
| D527,278 | S | 8/2006 | Ueda | | |
| 7,086,556 | B1 | 8/2006 | Trulove-Cranor | | |
| D585,224 | S | 1/2009 | Hwang | | |
| 7,661,560 | B2 | 2/2010 | Murray | | |
| D639,118 | S | 6/2011 | Huang | | |
| 8,083,102 | B2 | 12/2011 | Murray | | |
| 8,087,546 | B2 * | 1/2012 | Rabinovitch | B65D 55/10 | 222/105 |
| D667,665 | S | 9/2012 | DelGigante | | |
| D683,589 | S | 6/2013 | Itzek | | |
| D695,574 | S | 12/2013 | Min | | |
| D703,059 | S | 4/2014 | Chopdat | | |
| 8,875,929 | B1 | 11/2014 | Forney et al. | | |
| D721,925 | S | 2/2015 | Feldman | | |
| 9,801,481 | B2 | 10/2017 | Dunn | | |
| 2003/0019876 | A1 | 1/2003 | Burke | | |
| 2003/0218015 | A1 | 11/2003 | Randolph | | |
| 2006/0138168 | A1 * | 6/2006 | Last | B65D 35/28 | 222/105 |
| 2009/0008419 | A1 | 1/2009 | Tsang | | |
| 2009/0218357 | A1 | 9/2009 | Byrd | | |
| 2010/0150478 | A1 | 6/2010 | Murray | | |
| 2012/0248146 | A1 * | 10/2012 | Knudsen | B65D 77/067 | 222/105 |
| 2012/0255972 | A1 | 10/2012 | Schneider | | |
| 2013/0074456 | A1 | 3/2013 | Hradisky et al. | | |
| 2013/0082068 | A1 | 4/2013 | Engle | | |
| 2013/0084028 | A1 | 4/2013 | Cross | | |
| 2013/0341381 | A1 * | 12/2013 | Thomason | B65D 25/28 | 229/117.09 |
| 2014/0069945 | A1 | 3/2014 | Gubitosi | | |
| 2014/0158699 | A1 | 6/2014 | Kim | | |
| 2015/0024085 | A1 | 1/2015 | McBean et al. | | |
| 2015/0090622 | A1 * | 4/2015 | Bassi | A47J 47/14 | 206/457 |

FOREIGN PATENT DOCUMENTS

| | | |
|---|---|---|
| CA | 2867543 | 4/2015 |
| CH | 699971 | 5/2010 |
| DE | 102007059569 | 6/2009 |
| WO | 02087397 | 11/2002 |
| WO | WO 2005070267 | 8/2005 |
| WO | 2012164615 | 12/2012 |
| WO | WO 2014059223 | 4/2014 |
| WO | 2016038285 | 3/2016 |

OTHER PUBLICATIONS

"EasyPouch," Web page <http://easypouch.com/shop/>, 2 pages, Sep. 13, 2014, retrieved from Internet Archive Wayback Machine <http://web.archive.org/web/20140913150403/http://easypouch.com/shop/> on Mar. 31, 2015.

"Pouch Pal How to," Screen shots from YouTube video found on web page <https://www.youtube.com/watch?v=O-FHALGpnAw>, 10 pages, video published on Aug. 22, 2014, retrieved on May 7, 2015.

* cited by examiner

HOLDER FOR A SQUEEZE POUCH

RELATED APPLICATIONS

This application claims the benefit of priority of U.S. Provisional Patent Application No. 61/914,175, filed on Dec. 10, 2013, which is incorporated by reference herein in its entirety.

BACKGROUND OF THE INVENTION

Squeeze pouches may contain liquids and soft or pureed foods such as baby food, apple sauce, or yogurt. These squeeze pouches are generally flexible foil pouches with a plastic spout through which the food or beverage is dispensed. Squeeze pouches have become a popular way to serve baby food, because they allow babies and toddlers to feed themselves by sucking baby food out of the squeeze pouches, through the spout. Examples of squeeze pouches are disclosed in U.S. Pat. Nos. 7,661,560, 8,083,102, U.S. Pat. No. D527,278, U.S. Patent Application Publication No. 2013/0084028, and U.S. Patent Application No. 2012/0255972, the contents of which are incorporated by reference herein in their entireties.

A drawback to giving a squeeze pouch containing baby food to small children, including babies and toddlers, is that small children may squeeze the squeeze pouch with too much force when the plastic spout of the pouch is uncovered, causing the baby food to exit out of the pouch and be deposited onto the outside of the pouch or onto nearby surfaces. Also, young children may leave a squeeze pouch on the floor without covering the spout, and then sit or walk on the pouch, causing food to exit the pouch and land on the floor. Therefore, young children who eat from squeeze pouches may waste food and create a mess. Accordingly, a need exists for a holder for a squeeze pouch which allows small children to feed themselves from the squeeze pouch, while preventing them from squeezing the flexible portion of the pouch.

SUMMARY OF THE INVENTION

The present invention is directed to a holder for a squeeze pouch. The holder may have a one-piece construction, including a top wall and a side wall. Alternatively, the holder may include both a detachable top wall (or lid) and a housing, the housing having a side wall. In one embodiment, the holder includes a side wall and a top wall, wherein the top wall includes a slot adapted to receive a spout of the squeeze pouch. The side wall may include an aperture that is contiguous with the slot in the top wall. A handle may extend from the exterior surface of the side wall.

In one embodiment, the holder includes a housing and a lid. The housing has a top end and a base, and includes a side wall. The lid, which is adapted to engage the top end of the housing, has a top wall, a lid side wall, and a slot. The slot extends through the lid side wall and into the top wall. The slot is adapted to receive the spout of a squeeze pouch. A handle may extend from the exterior surface of the side wall.

In another embodiment, the holder includes a housing and a lid. The housing has a top end and a base, and includes a side wall. An extension locking lug extends from an exterior surface of the side wall. The lid, which is adapted to engage the top end of the housing, has a top wall, a lid side wall, and a slot. The slot extends through the lid side wall and into the top wall. A lid extension extends from the bottom of the lid. The lid extension includes an extension aperture which is adapted to receive the extension locking lug. The lid may also include a first prong and a second prong extending from the bottom of the lid, each prong including a leg portion bent toward a center of the lid. The housing may further include a pair of housing apertures, wherein one housing aperture is adapted to receive the leg portion of the first prong, and the other housing aperture is adapted to receive the leg portion of the second prong. A handle may extend from the exterior surface of the side wall.

An object of the present invention is to provide a holder for a squeeze pouch which allows small children to feed themselves from the squeeze pouch, while preventing them from squeezing the flexible portion of the pouch.

Another object of the present invention is to provide a holder for a squeeze pouch which allows the squeeze pouch to be securely placed in the holder without removing the cap of the squeeze pouch.

A further object of the present invention is to provide a holder for a squeeze pouch which secures the spout of the squeeze pouch in the lid or top wall of the holder, such that the spout of the squeeze pouch cannot be removed from the lid or top wall without the application of force.

A further object of the present invention is to provide a holder for a squeeze pouch which allows a user to have access to the flexible portion of the pouch without removing the squeeze pouch from the holder.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
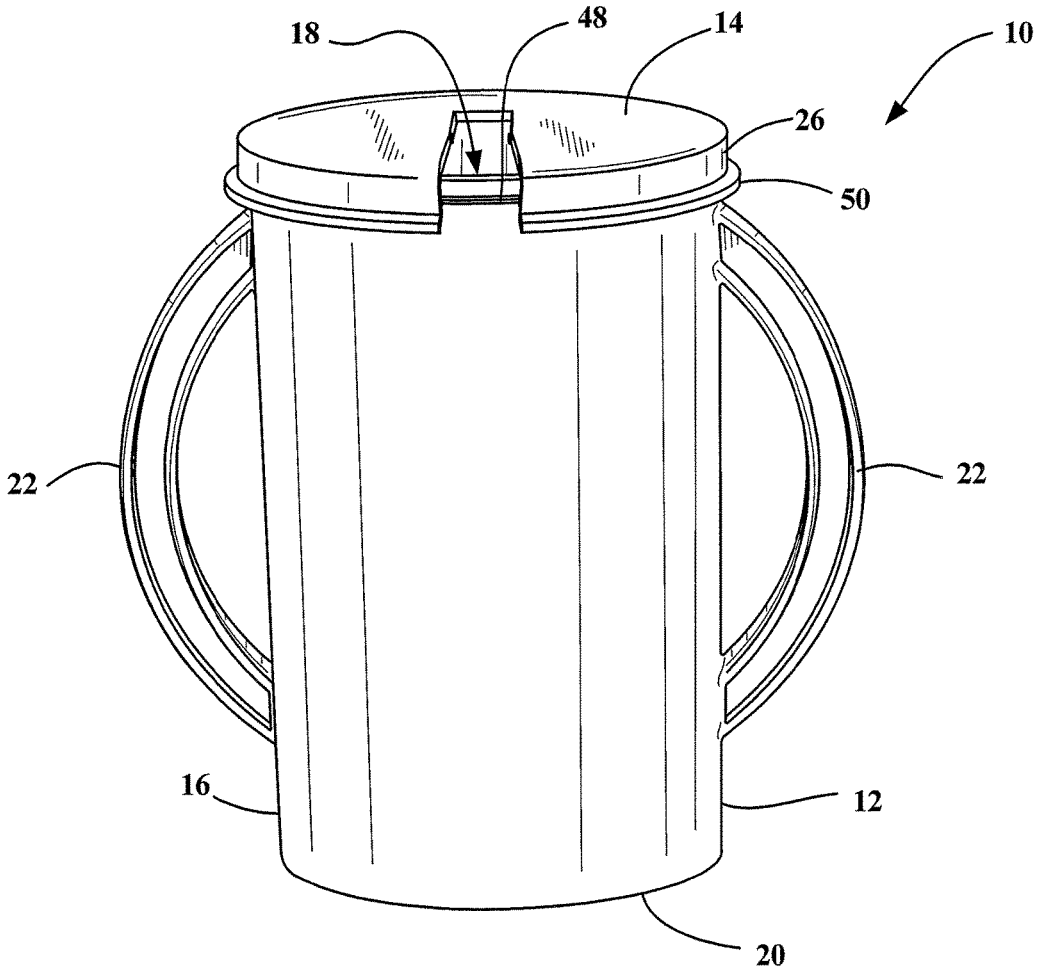
FIG. 1 is a perspective view of an embodiment of the holder of the present invention.

As shown in FIG. 1, one embodiment of the present invention is a holder 10 for a squeeze pouch. The holder 10 includes a housing 12 and a detachable top wall or lid 14. The housing 12 includes a side wall 16, and has a top end 18 and a bottom end or base 20. In the embodiments shown in the figures, the housing 12 has a cylindrical shape with an elliptical cross-section, and therefore only comprises one side wall 16. However, in alternative embodiments, the housing 12 may have different shapes, such as a rectangular prismatic shape including four side walls, or a triangular prismatic shape including three side walls. The housing 12 may have a shape similar to a cylinder or an elliptical cylinder, but with a cross-section including corners, such that the housing 12 includes more than one side wall.

In the embodiment shown in FIG. 1, the side wall 16 does not include an aperture. However, in alternative embodiments, the side wall 16 may include one or more apertures, such as an aperture for viewing or accessing the squeeze pouch once it is contained in the holder 10.

Handles 22 extend from the exterior surface of the side wall 16. The holder 10 depicted in FIG. 1 includes two handles 22, but other embodiments may have a greater or lesser number of handles, or may have no handles. In the embodiments shown in the figures, each handle 22 is attached to side wall 16 at both ends of the handle, and there are no gaps in the handle. In other words, each handle 22 has a closed design. The closed design of handle 22 is advantageous because it allows an attachment device such as a clip, ring, or cord to be attached to the handle, without sliding off of an end of the handle or sliding through a gap in the handle. A cord may be attached directly to handle 22, or a cord may be attached to the handle through a clip, ring, or the like. Attaching a cord to handle 22 allows the holder 10 to be tethered or clipped to an object such as a stroller, playpen, or crib, so that a child cannot throw the holder onto the ground and/or lose the holder. The holder 10 may also be tethered or clipped to a jacket or other clothing, so that a child cannot throw the holder and/or lose the holder. However, although there are advantages to the design of handle 22 shown in FIG. 1, other embodiments of the invention may include handles having different shapes and designs, including a design in which an end of the handle is not attached to side wall 16, or a design including a gap in the handle. A ring or other attachment device may be permanently affixed to a point on the handle or elsewhere on the holder, so that, even in an embodiment in which the handle does not have a closed design as shown in FIG. 1, attaching a cord to the holder may still be possible.

Figure 2:
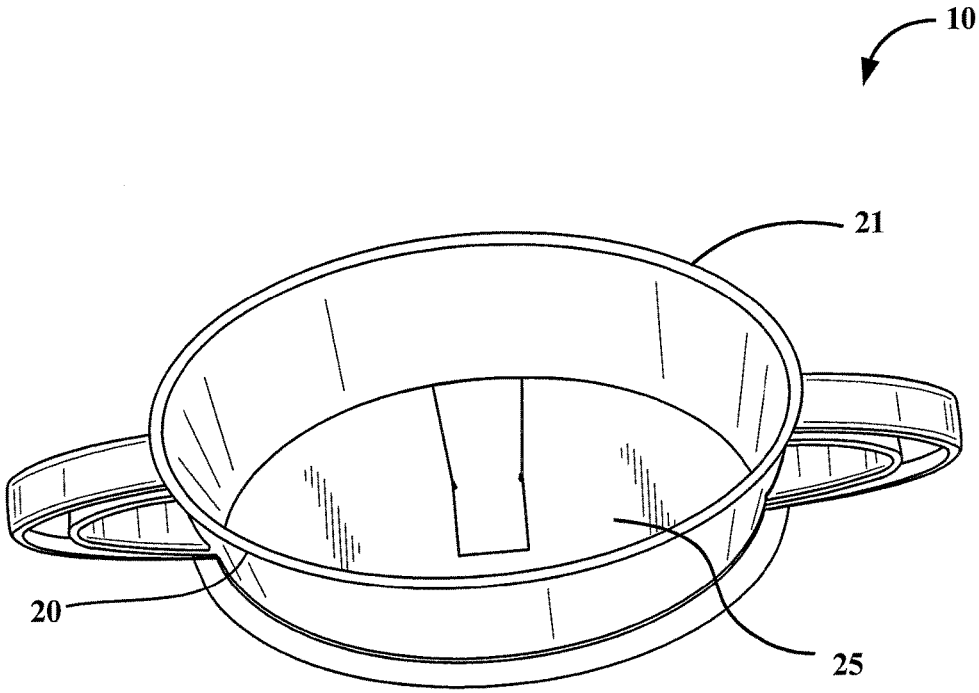
FIG. 2 is a bottom perspective view of the holder of FIG. 1.
Figure 3:
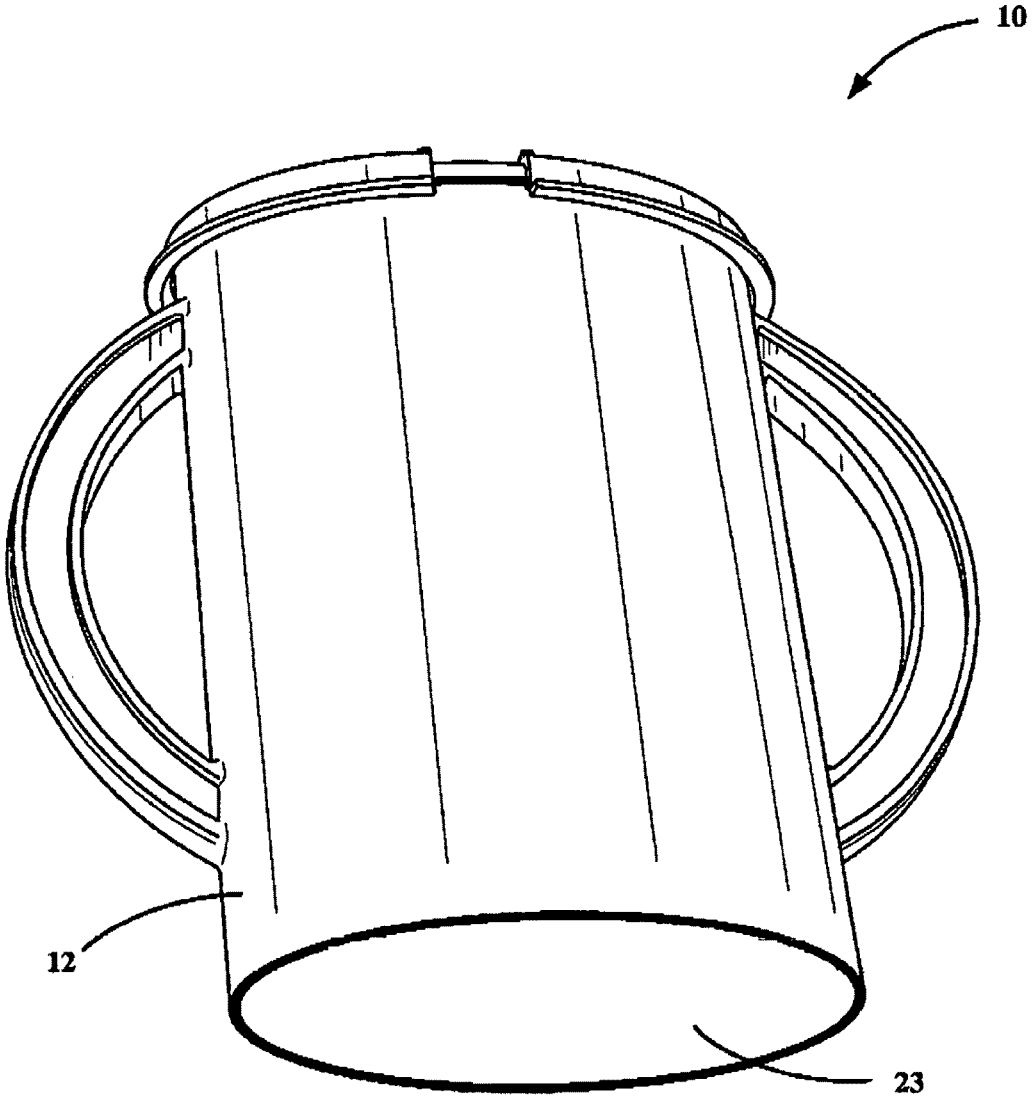
FIG. 3 is a bottom perspective view of a second embodiment of the holder of the present invention.

FIG. 2 is a bottom perspective view of the holder 10. As shown in FIG. 2, the base 20 of holder 10 comprises a bottom edge 21 and a base aperture 25. Therefore, when the holder 10 is placed upright on a flat surface, only the bottom edge 21 contacts the surface. In this embodiment, the bottom edge 21 defines the edge of base aperture 25. However, in some embodiments of the present invention, as shown in the embodiment of FIG. 3, the base 20 of holder 10 includes a bottom wall 23. The bottom wall 23 may include an opening, or base aperture 25, such that the interior of the housing 12 may be accessed through the base 20, via base aperture 25, despite the presence of the bottom wall 23.

Figure 4:
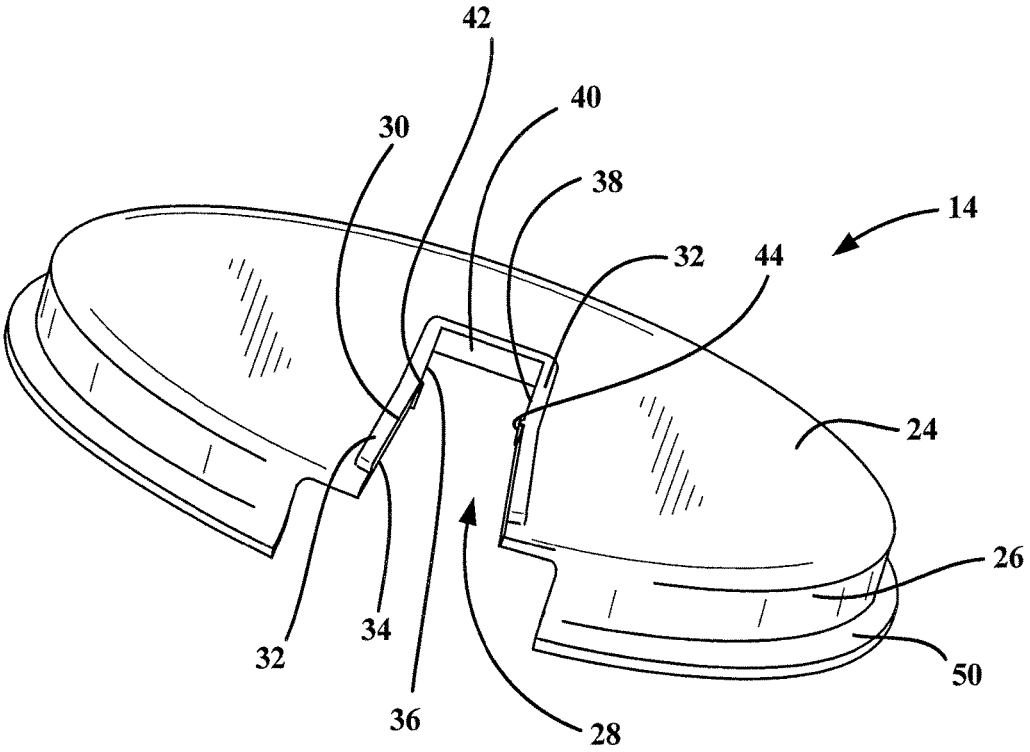
FIG. 4 is a perspective view of the lid of the holder of FIG. 1.
Figure 5:
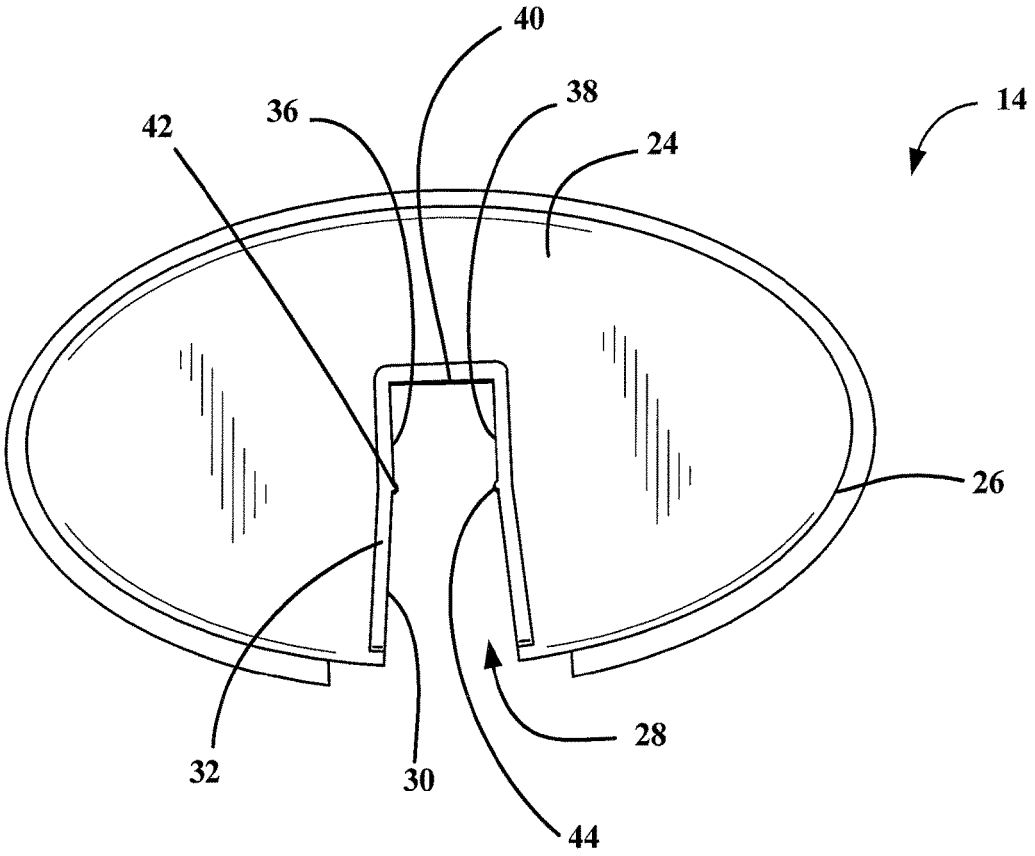
FIG. 5 is a top view of the lid of FIG. 4.

FIG. 4 is a perspective view of the lid 14, while FIG. 5 is a top view of the lid 14. The lid 14 includes a top wall 24, a lid side wall 26, and a slot 28. The slot 28 passes through both the lid side wall 26 and the top wall 24. The top wall 24 includes an inner edge 30 which defines the boundary of the portion of the slot 28 which passes through the top wall 24. A ridge 32 extends from the top surface of the top wall 24, proximate to the slot 28. The interior portion 34 of the ridge 32 forms part of the inner edge 30 of the top wall 24. The inner edge 30 includes a first wall 36, a second wall 38, and a back wall 40, wherein the first wall 36 is opposite the second wall 38, and the back wall 40 extends between the first wall 36 and the second wall 38. A first projection 42 extends inwardly from the first wall 36 of the inner edge 30, while a second projection 44 extends inwardly from the second wall 38, toward projection 42.

Figure 6:
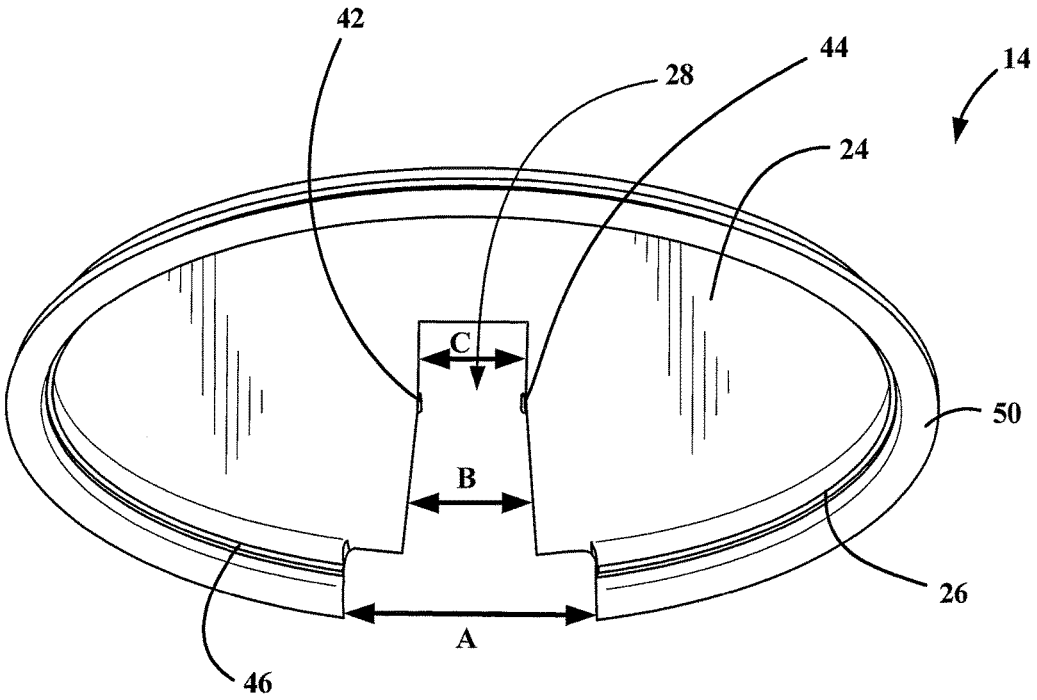
FIG. 6 is a bottom perspective view of the lid of FIG. 4.

The slot 28 may have various different shapes or configurations. In the embodiments shown in the figures, the slot 28 is wider where it extends through the lid side wall 26 than where it extends through the top wall 24. The width of the slot 28 through the lid side wall 26, or the "lid side wall slot width," is represented by distance A in FIG. 6. As the slot 28 extends from the lid side wall 26 toward the center of the top wall 24, the slot has a width which tapers inwardly from the lid side wall 26 to projections 42, 44. The width of the slot 28 is then substantially constant from the projections 42, 44 to the back wall 40. As shown in FIG. 6, the width of the slot 28 at any location through the top wall 24, such as the width depicted as distance B or the width depicted as distance C, is less than the lid side wall slot width.

The lid 14 is adapted to engage the top end 18 of the side wall 16 of housing 12. As shown in FIG. 6, which depicts a bottom perspective view of the lid 14, the lid side wall 26 includes a housing locking lug 46 projecting from an interior surface of the lid side wall. As shown in FIG. 1, the side wall 16 of the housing 12 includes a lid locking lug 48 projecting from an exterior surface of the side wall, proximate to the top end 18 of the side wall. The lid 14 may be made from a material that is sufficiently resilient such that when the lid 14 is pushed into place on the top end 18 of the side wall 16, the housing locking lug 46 is able to slide past the lid locking lug 48 and then rest below the lid locking lug. The force of the lid locking lug 48 against the housing locking lug 46 assists in preventing the lid 14 from lifting upward off of the housing 12.

The lid 14 includes an outer ridge 50 extending outward from the lid side wall 26. The outer ridge 50 facilitates removal of the lid 14 from the housing 12, because a user may exert upward pressure on outer ridge 50 to remove the lid. The user may also exert downward pressure on outer ridge 50 when locking the lid 14 onto the housing 12.

Figure 7:
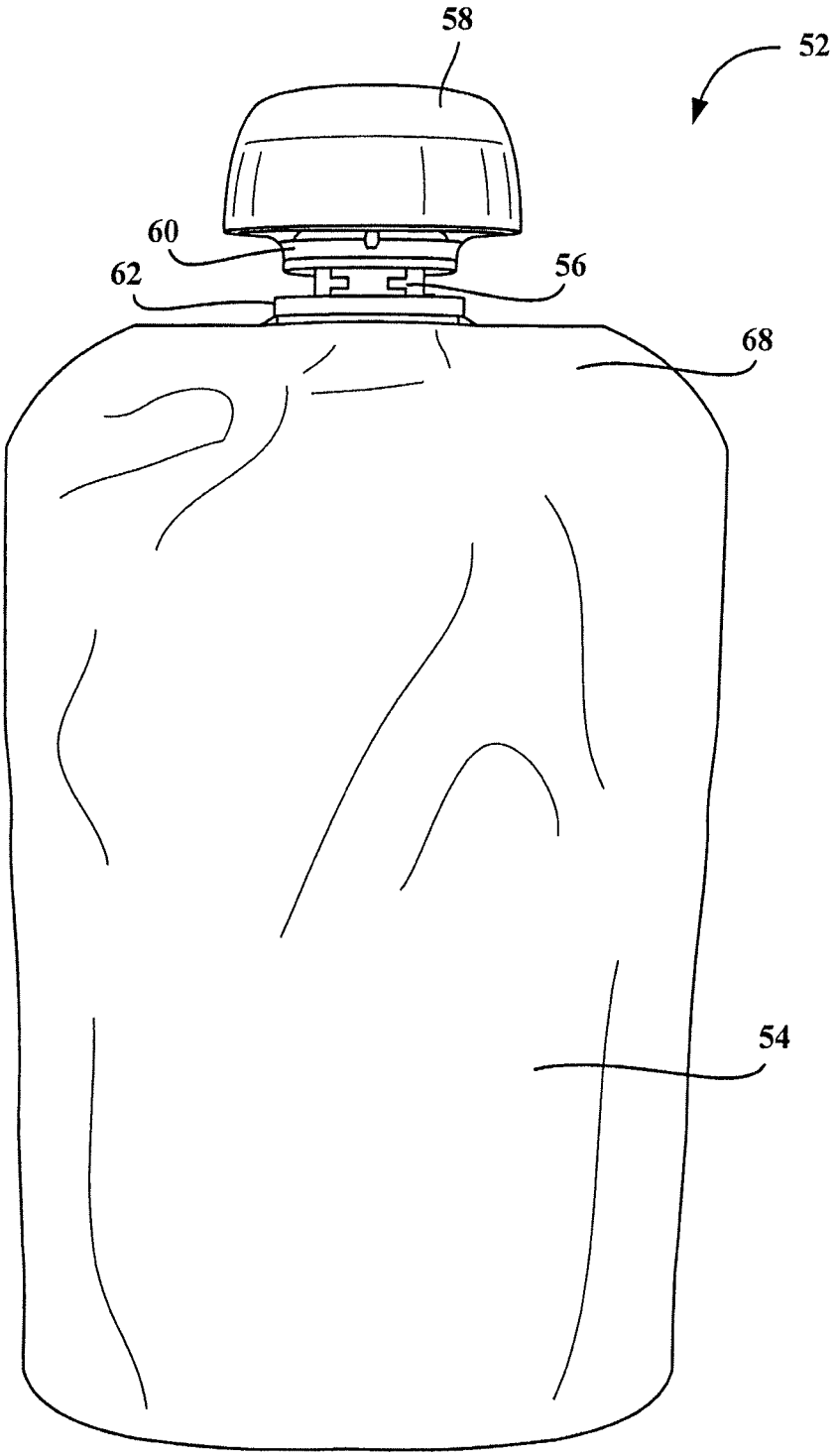
FIG. 7 is a side view of a squeeze pouch which may be used with the holder of FIG. 1.

The holder 10 of the present invention is designed to hold a squeeze pouch such as the squeeze pouch 52 depicted in FIG. 7. Squeeze pouch 52 includes a pouch 54 (i.e., the flexible portion of the squeeze pouch) containing a food or beverage. The food or beverage is dispensed through a plastic spout 56. A cap 58 may be used to cover the plastic spout 56. The spout 56 includes an upper flange 60 and a lower flange 62.

Figure 8:
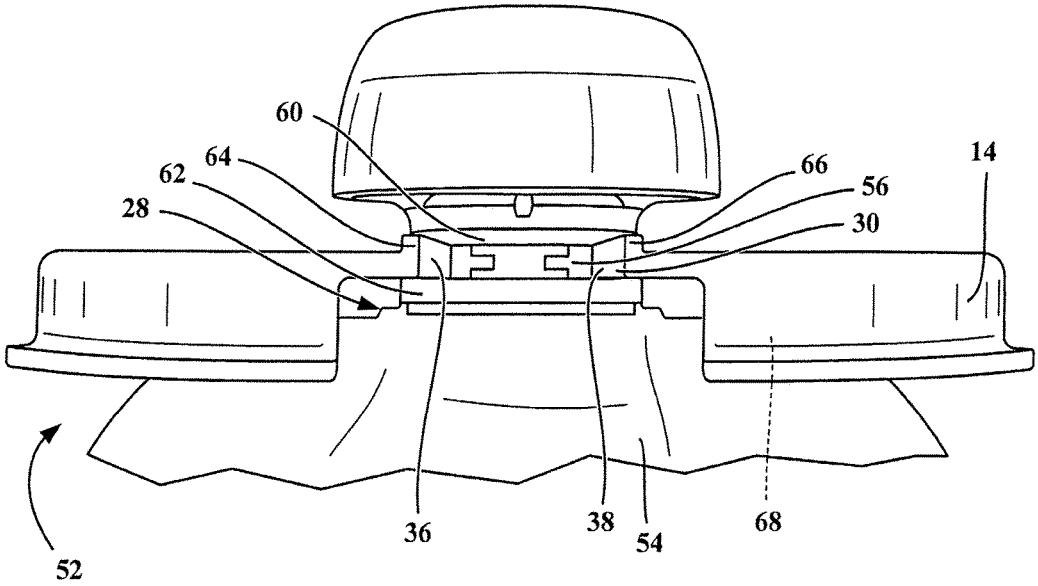
FIG. 8 is a side view of the lid of FIG. 4 holding the squeeze pouch of FIG. 7.

The slot 28 of the lid 14 is adapted to receive the spout 56 of the squeeze pouch 52 such that the lid 14 is able to securely hold the spout 56, as shown in FIG. 8. To secure the spout 56 in the lid 14, the user aligns the spout 56 with the inner edge 30 of the lid 14 such that the front surface 64 of first wall 36, and the front surface 66 of second wall 38, is placed between the upper flange 60 and lower flange 62 of the spout 56. The top 68 of the pouch 54 is bent inward prior to aligning the spout 56 with the inner edge 30 of the lid 14, so that the top 68 of the pouch 54 is able to pass through the portion of slot 28 which extends through the lid side wall 26. Once the spout 56 is aligned with the inner edge 30, the spout 56 is pushed toward the center of lid 14, through the portion of slot 28 which extends through the top wall 24 of the lid. The spout 56 is pushed past projections 42 and 44, until the spout 56 is located with the projections 42 and 44 in front of the spout, and the back wall 40 of inner edge 30 in back of the spout. The first wall 36, second wall 38, and back wall 40 of the inner edge 30 may each be in contact with the spout 56 when the spout is secured to lid 14, or there may be a space between any or all of walls 36, 38, 40 and the spout 56.

The projections 42 and 44 lock the spout 56 in place such that the spout cannot be removed from the lid 14 without the application of force. The ridge 32 provides added stability, because the ridge allows the inner edge 30 of top wall 24 to be sized to fit securely between the upper flange 60 and lower flange 62 of a typical squeeze pouch. Also, because the width of slot 28 tapers inward as the slot passes through the top wall 24, the slot 28 is able to be sufficiently narrow behind projections 42 and 44 to hold the spout 56 securely. However, because the width of slot 28 is wider toward the edge of the top wall 24, it is easier to pass the spout 56 through the slot 28 than it would be if the slot was narrow along its entire length. The lid side wall slot width A (see FIG. 6) is greater than the width of the slot 28 through the top wall 24 to allow the top 68 of the pouch 54 to pass through the lid side wall 26, after the top 68 is bent inward. This allows the squeeze pouch 52 to be secured to the lid 14 by pushing the spout 56 directly backward through the slot 28, without the need to turn the squeeze pouch 52 in order to navigate the pouch 54 through the lid side wall 26.

Slot 28 of the embodiment shown in FIG. 6 is sized and shaped to allow a spout 56 with flanges 60, 62 to slide through the slot, and to be secured to the lid 14 as described above. The configuration of slot 28 is advantageous because it allows a squeeze pouch 52 to be secured to the lid 14 without removing cap 58. Also, after cap 58 is removed, the configuration of slot 28 allows cap 58 to be securely placed back onto the spout 56 without removing the squeeze pouch 52 from holder 10. However, in other embodiments of the present invention, slot 28 may be sized and shaped differently. For example, in some embodiments, the slot may not extend through lid side wall 26, and the slot may be designed to allow a spout 56 to be raised through the slot from below the lid 14. The slot may also be designed to allow lid 14 to be screwed onto a spout 56, in the manner of a screw-top lid. Moreover, in an embodiment in which the lid 14 is made from a resilient or stretchy material, the slot 28 may be designed to hold the spout 56 in the lid through the frictional force caused by the resilience of the lid material. Such alternative designs may be advantageous for holders 10, when used to contain squeeze pouches 52 which do not have spouts 56 including flanges 60, 62.

Figure 9:
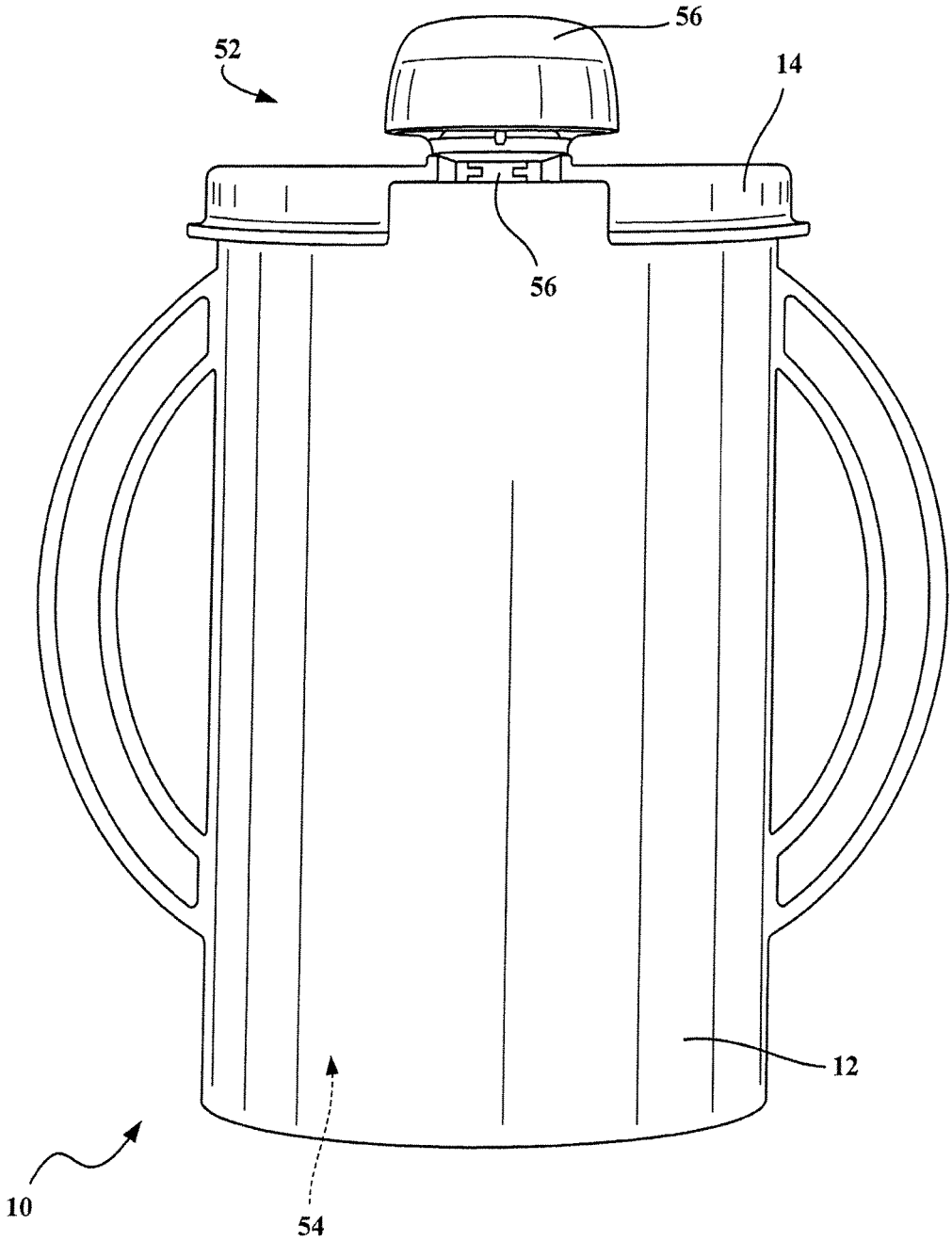
FIG. 9 is a side view of the holder of FIG. 1 containing the squeeze pouch of FIG. 7.

After the spout 56 is secured in the lid 14, the pouch 54 is lowered into the housing 12, and the user places the lid 14 on the housing 12. The holder 10 then contains the squeeze pouch 52. FIG. 9 shows the holder 10 containing a squeeze pouch 52. As shown in the figure, the cap 58 is on the squeeze pouch 52. Due to the design of the lid 14, the spout 56 of the squeeze pouch 52 may be secured to the lid 14 without removing the cap 58. This is advantageous because once the cap is removed from many squeeze pouches containing foods or beverages, the squeeze pouches must then be refrigerated. Therefore, if the cap 58 needed to be removed from squeeze pouch 52 prior to securing the spout 56 to lid 14, the food or beverage in the squeeze pouch 52 would either need to be refrigerated or consumed immediately after the squeeze pouch was secured in the holder 10. However, because the embodiments shown in the figures allow the cap 58 to remain on the squeeze pouch 52 when it is placed in the holder 10, the squeeze pouch 52 may be placed in the holder 10 well before the food or beverage in the squeeze pouch is consumed. This is useful in situations such as car trips with children, because a parent may place a squeeze pouch in the holder before beginning the car trip. Then, if a child becomes hungry during the trip, the parent may give the holder containing the squeeze pouch to the child, without stopping to place the squeeze pouch in the holder.

In the embodiment shown in FIG. 2, the housing 12 does not include a bottom wall 23. Therefore, the pouch 54 of squeeze pouch 52 may be accessed through the base 20 of the housing 12, without removing the squeeze pouch 52 from the holder 10. This may be useful so that a user may check to see whether any food or beverage is left in the pouch 54. Also, sometimes it may be necessary to press on the pouch 54 in order to squeeze food up from the bottom of the pouch 54 toward the top. The lack of a bottom wall allows pouch 54 to be accessed easily. However, even if the housing 12 includes a bottom wall 23, sufficient access may be provided without removing the squeeze pouch 52 from the holder 10, if the bottom wall 23 includes an opening or base aperture 25. The bottom wall 23 may also be removable, like lid 14. The bottom wall 23 may then be secured to the bottom end of housing 12 in a manner similar to the way in which lid 14 is secured to top end 18 of the housing. Alternatively, bottom wall 23 may be made from a resilient or stretchy material which stretches over the bottom end of the housing 12. In an embodiment with a removable bottom wall 23, the bottom wall may be placed on housing 12 in order to protect the pouch 54 from all sides, and later removed in order to view or access the pouch.

The holder 10 may be constructed from a variety of materials, such as but not limited to plastic or silicone materials. For example, the holder 10 may be made from a shatterproof, dishwasher-safe, substantially rigid plastic. The plastic may be sufficiently rigid such that if a child eating from a squeeze pouch exerts pressure on the side wall 16 of the housing 12, the side wall 16 will not become indented to the extent that pressure is placed on the pouch 54. Also, the plastic may be sufficiently rigid such that if a child sits on or steps on a holder 10 containing a squeeze pouch 52, the side wall 16 will not become indented to the extent that pressure is placed on the pouch 54. This rigidity is advantageous because if pressure is placed on the pouch 54 of a squeeze pouch 52 containing food, the pressure may cause food to exit the spout 56. In some embodiments, the holder 10, or at least the housing 12, may be constructed from a transparent plastic. A transparent housing would allow a user to see whether any food or beverage is left in the squeeze pouch 52, without the need to look at the pouch 54 through the bottom of the housing 12.

The holder of the present invention may be made in a variety of shapes and dimensions which accommodate squeeze pouches. However, in one embodiment, the dimensions are approximately as follows. The height of the holder 10, when the lid 14 is secured to the housing 12, is approximately 5.5 inches. The width of the housing 12 is approximately 3.25 inches at its widest width, and approximately 1.75 inches at its narrowest width. The height of the lid 14 is between approximately 0.75 inch and 1.0 inch. The lid side wall slot width A is approximately 1.0 inch. The width of the slot 28 through the top wall 24 of the lid 14, at the edge of the lid, is between approximately 0.5 inch and 0.75 inch. The width of the slot 28 at the back wall 40 is between approximately 0.25 inch and 0.5 inch. The height of the inner edge 30 is approximately 0.125 inch.

Figure 10:
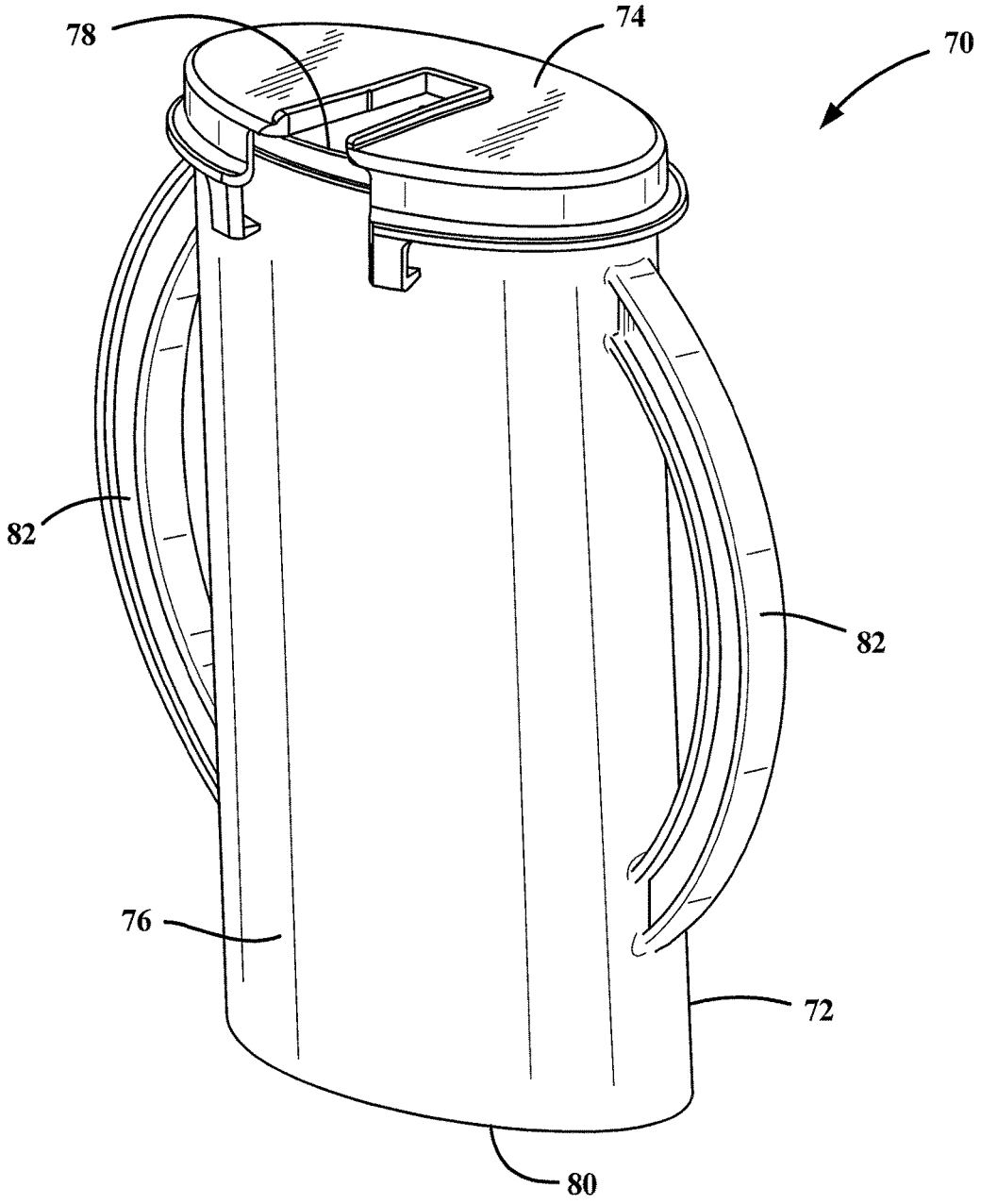
FIG. 10 is a perspective view of a third embodiment of the holder of the present invention.

FIG. 10 depicts another embodiment of the present invention. In the embodiment shown in FIG. 10, the holder 70 includes a housing 72 and a detachable top wall or lid 74. The housing 72 includes a side wall 76, and has a top end 78 and a bottom end or base 80. In the embodiments shown in the figures, the housing 72 has a cylindrical shape with an elliptical cross-section, and therefore only comprises one side wall 76. However, in alternative embodiments, the housing 72 may have different shapes, such as a rectangular prismatic shape including four side walls, or a triangular prismatic shape including three side walls. The housing 72 may have a shape similar to a cylinder or an elliptical cylinder, but with a cross-section including corners, such that the housing 72 includes more than one side wall.

Handles 82 extend from the exterior surface of the side wall 76. The holder 70 depicted in FIG. 10 includes two handles 82, but other embodiments may have a greater or lesser number of handles, or may have no handles. In the embodiments shown in the figures, each handle 82 is attached to side wall 76 at both ends of the handle, and there are no gaps in the handle. In other words, each handle 82 has a closed design. The closed design of handle 82 is advantageous because it allows an attachment device such as a clip, ring, or cord to be attached to the handle, without sliding off of an end of the handle or sliding through a gap in the handle. A cord may be attached directly to handle 82, or a cord may be attached to the handle through a clip, ring, or the like. Attaching a cord to handle 82 allows the holder 70 to be tethered or clipped to an object such as a stroller, playpen, or crib, so that a child cannot throw the holder onto the ground and/or lose the holder. The holder 70 may also be tethered or clipped to a jacket or other clothing, so that a child cannot throw the holder and/or lose the holder. However, although there are advantages to the design of handle 82 shown in FIG. 10, other embodiments of the invention may include handles having different shapes and designs, including a design in which an end of the handle is not attached to side wall 76, or a design including a gap in the handle. A ring or other attachment device may be permanently affixed to a point on the handle or elsewhere on the holder, so that, even in an embodiment in which the handle does not have a closed design as shown in FIG. 10, attaching a cord to the holder may still be possible.

Figure 11:
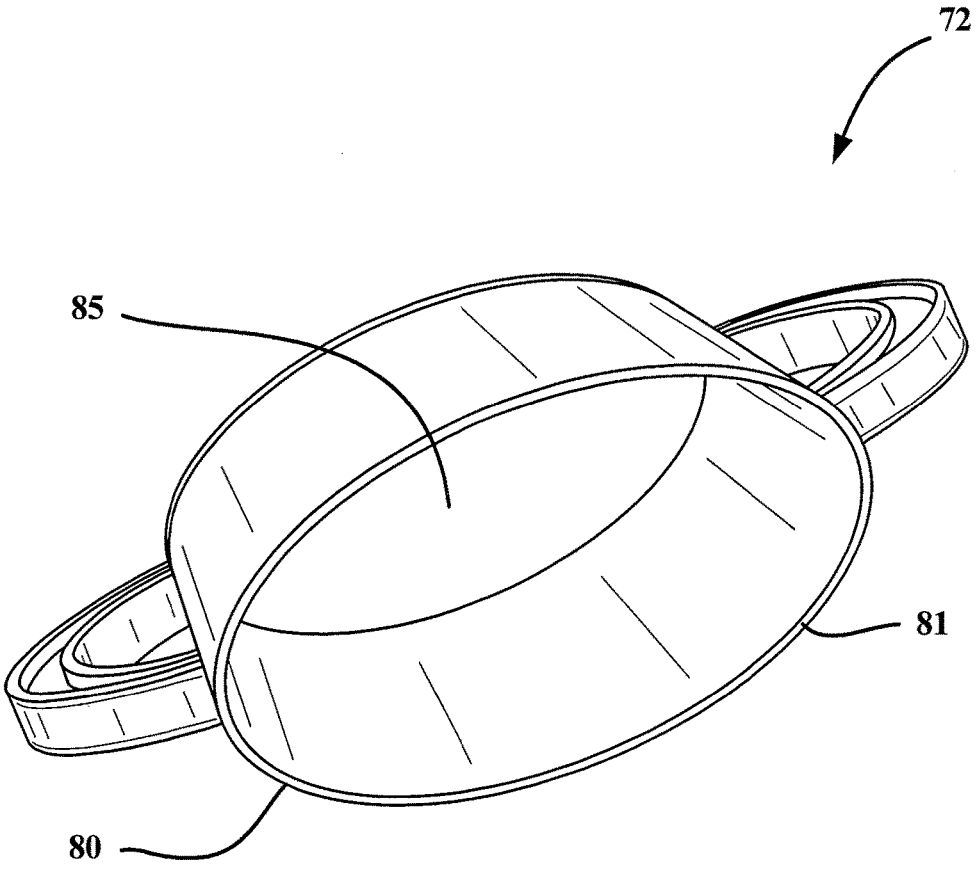
FIG. 11 is a bottom perspective view of the housing of the holder of FIG. 10.
Figure 12:
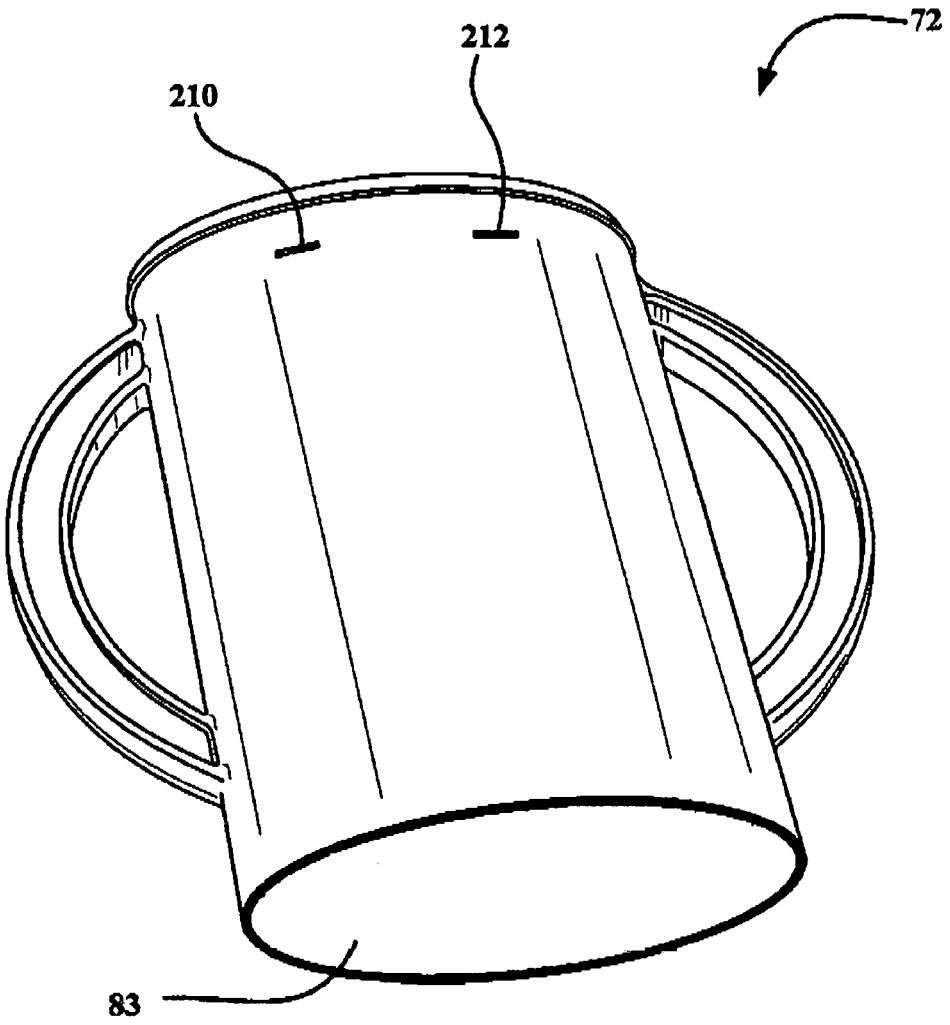
FIG. 12 is a bottom perspective view of a housing of a fourth embodiment of the holder of the present invention.

FIG. 11 is a bottom perspective view of the housing 72. As shown in FIG. 11, the base 80 of holder 70 comprises a bottom edge 81 and a base aperture 85. Therefore, when the holder 70 is placed upright on a flat surface, only the bottom edge 81 contacts the surface. However, in some embodiments of the present invention, as shown in the embodiment of FIG. 12, the base 80 of holder 70 includes a bottom wall 83. The bottom wall 83 may include an opening, or base aperture 85, such that the interior of the housing 72 may be accessed through the base 80, via base aperture 85, despite the presence of the bottom wall 83. The bottom wall 83 may also be removable, like lid 74. The bottom wall 83 may then be secured to the bottom end of housing 72 in a manner similar to the way in which lid 74 is secured to top end 78 of the housing. Alternatively, bottom wall 83 may be made from a resilient or stretchy material which stretches over the bottom end of the housing 72. In an embodiment with a removable bottom wall 83, the bottom wall may be placed on housing 72 in order to protect the pouch 54 from all sides, and later removed in order to view or access the pouch.

Figure 13:
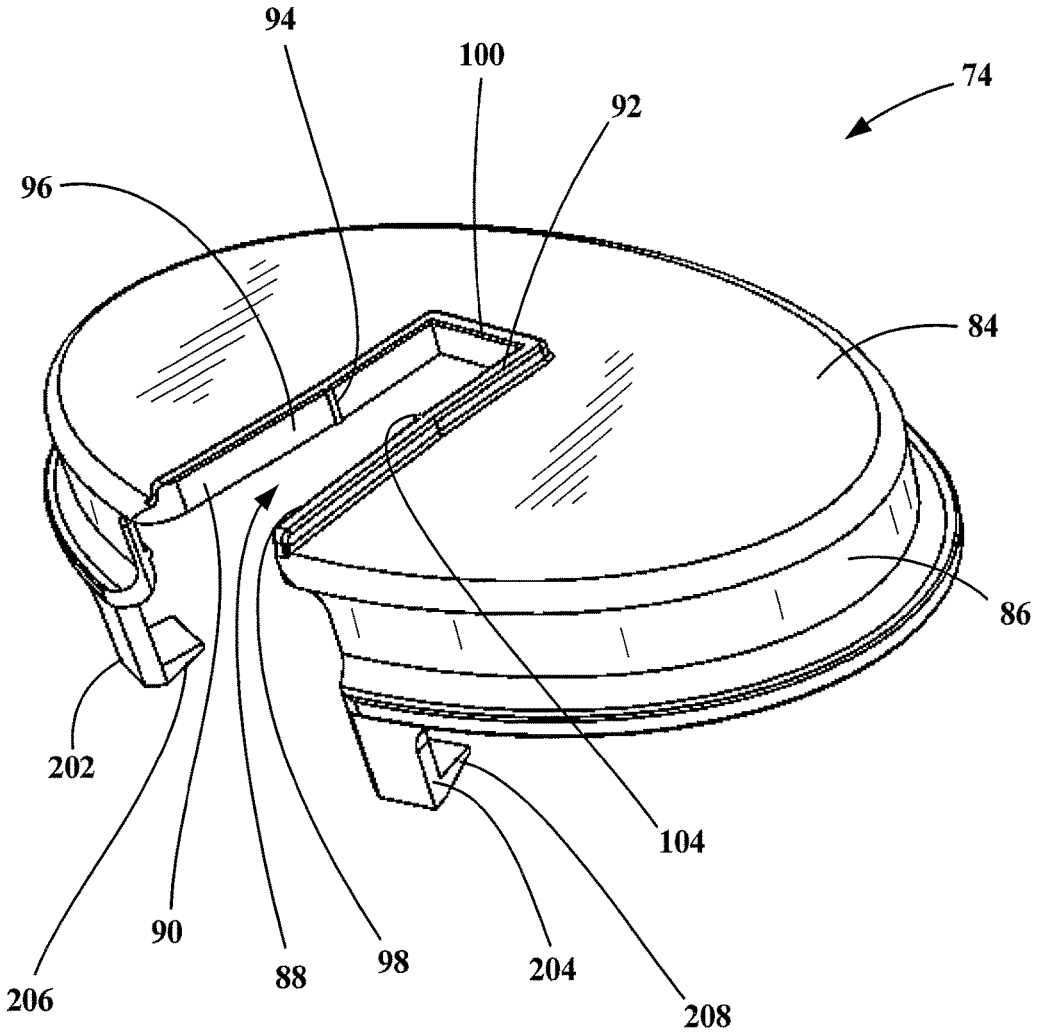
FIG. 13 is a front perspective view of the lid of the holder of FIG. 10.
Figure 14:
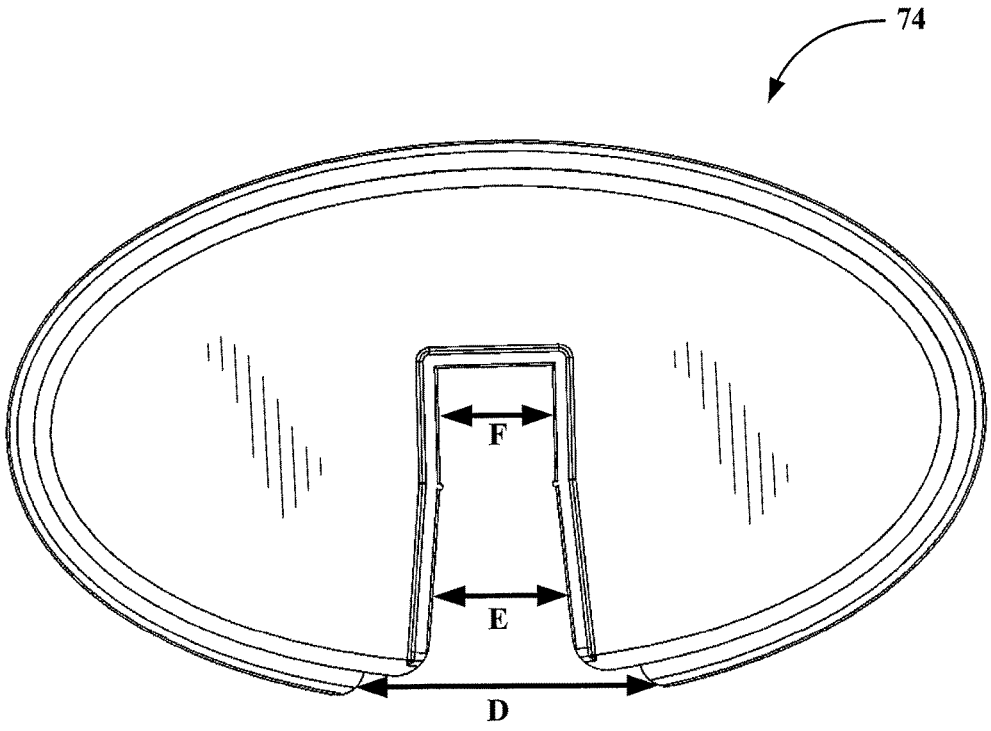
FIG. 14 is a top view of the lid of FIG. 13.
Figure 15:
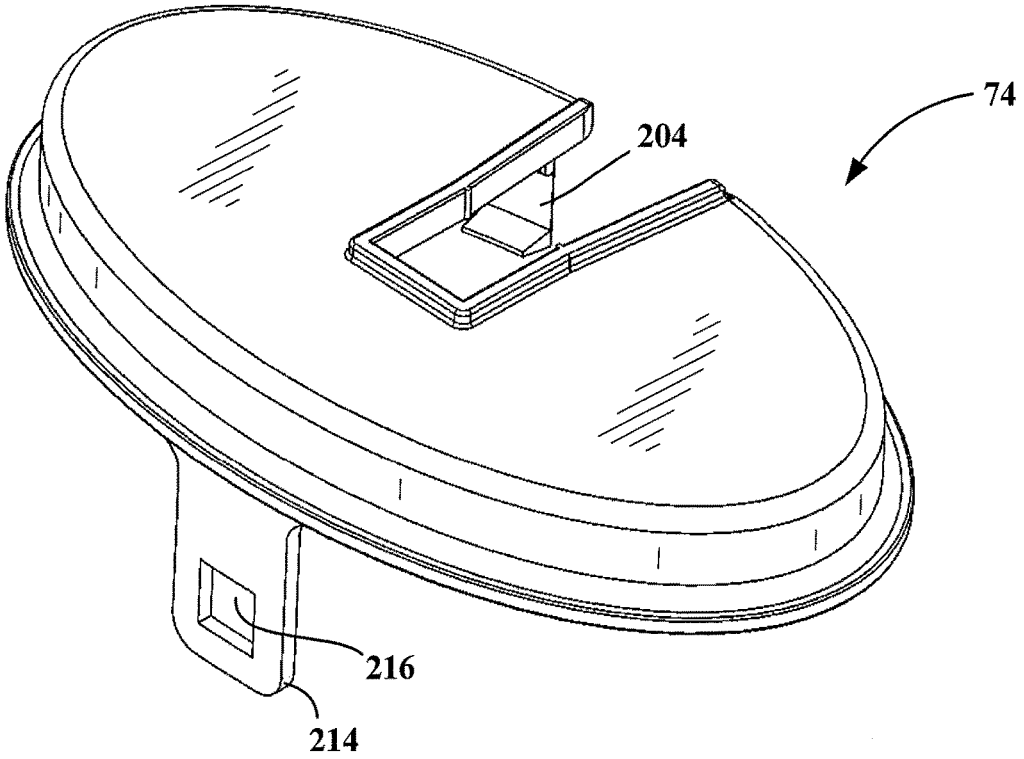
FIG. 15 is a back perspective view of the lid of FIG. 13.

FIG. 13 is a front perspective view of the lid 74, while FIG. 14 is a top view of the lid 74, and FIG. 15 is a back perspective view of the lid 74. The lid 74 includes a top wall 84, a lid side wall 86, and a slot 88. The slot 88 passes through both the lid side wall 86 and the top wall 84. The top wall 84 includes an inner edge 90 which defines the boundary of the portion of the slot 88 which passes through the top wall 84. A ridge 92 extends from the top surface of the top wall 84, proximate to the slot 88. The interior portion 94 of the ridge 92 forms part of the inner edge 90 of the top wall 84. The inner edge 90 includes a first wall 96, a second wall 98, and a back wall 100, wherein the first wall 96 is opposite the second wall 98, and the back wall 100 extends between the first wall 96 and the second wall 98. A first projection 102 extends inwardly from the first wall 96 of the inner edge 90, while a second projection 104 extends inwardly from the second wall 98, toward projection 102.

The slot 88 may have various different shapes or configurations. In the embodiments shown in the figures, the slot 88 is wider where it extends through the lid side wall 86 than where it extends through the top wall 84. A width of the slot 88 through the lid side wall 86, or the "lid side wall slot width," is represented by distance D in FIG. 14. As the slot 88 extends from the lid side wall 86 toward the center of the top wall 84, the slot has a width which tapers inwardly from the lid side wall 86 to projections 102, 104. The width of the slot 88 is then substantially constant from the projections 102, 104 to the back wall 100. As shown in FIG. 14, the width of the slot 88 at any location through the top wall 84, such as the width depicted as distance E or the width depicted as distance F, is less than the lid side wall slot width.

Figure 16:
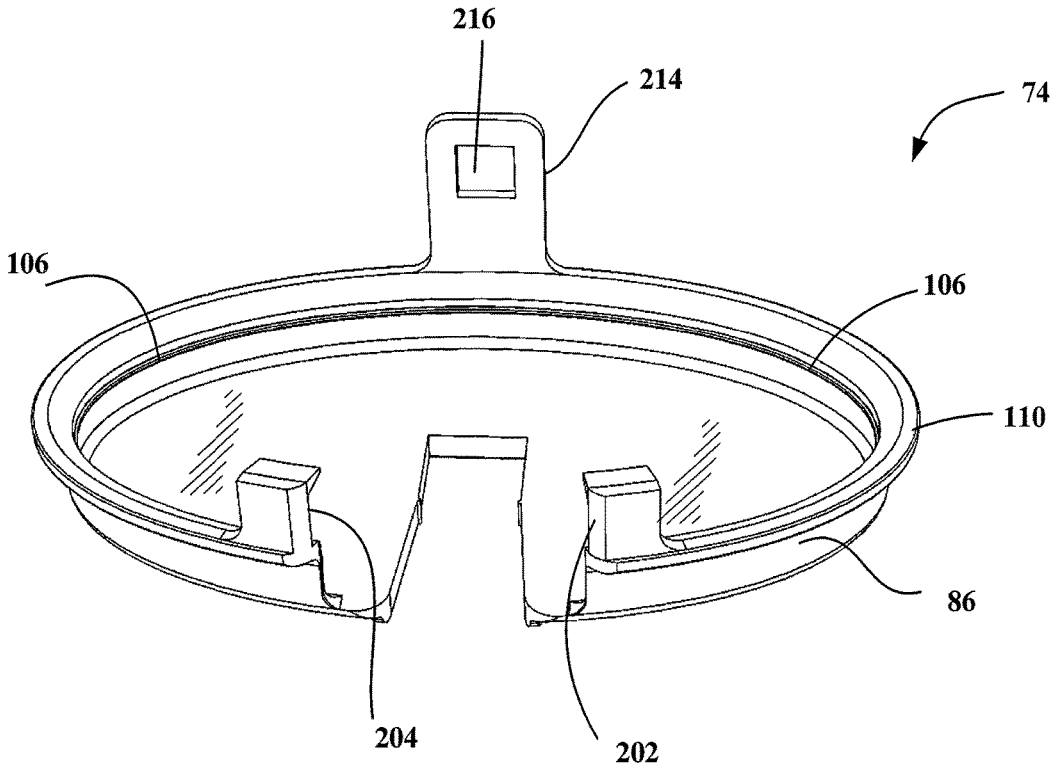
FIG. 16 is a bottom perspective view of the lid of FIG. 13.
Figure 17:
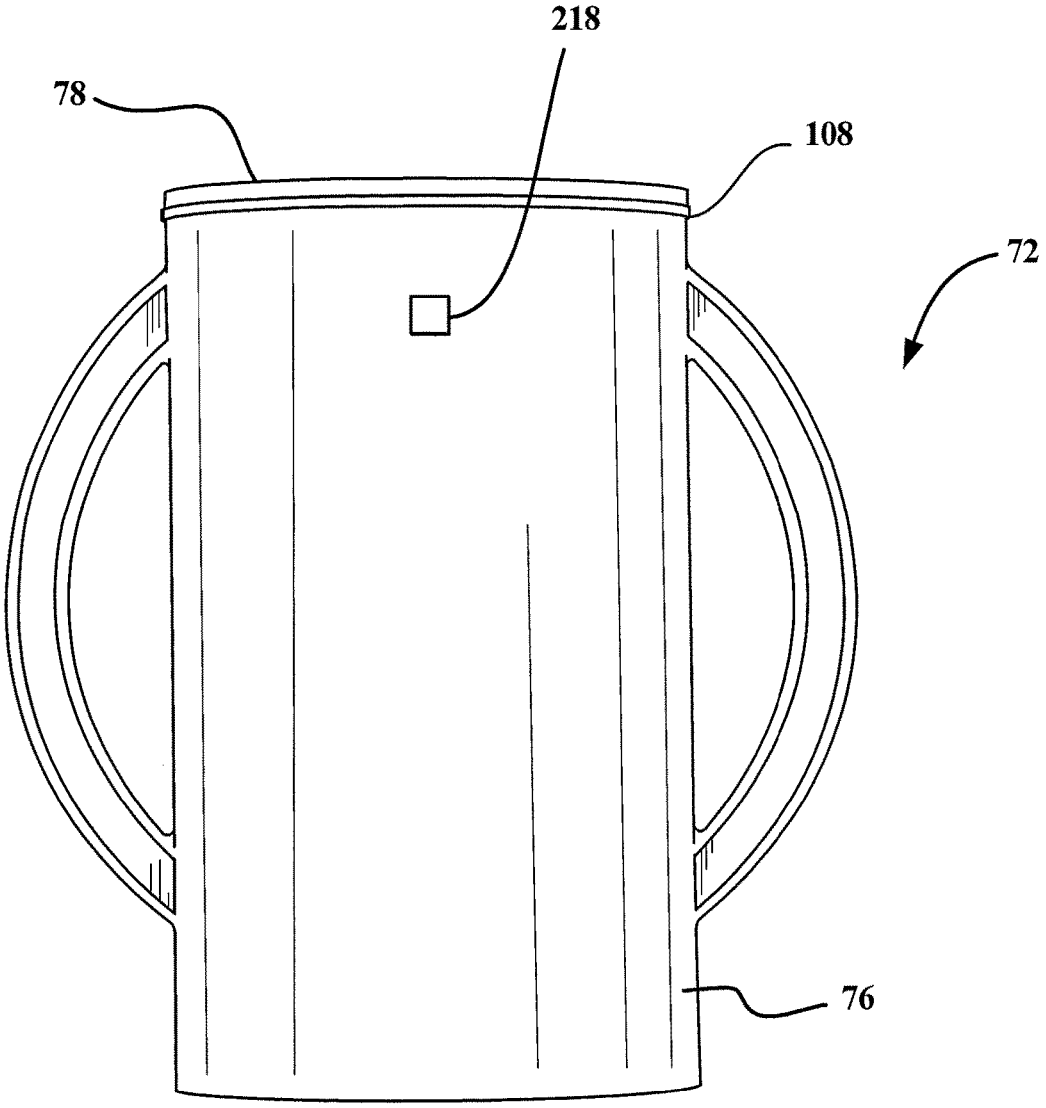
FIG. 17 is a back view of the housing of FIG. 11.

The lid 74 is adapted to engage the top end 78 of the side wall 76 of housing 72. As shown in FIG. 13, which shows a front perspective view of lid 74, and FIG. 16, which shows a back perspective view of lid 74, first prong 202 and second prong 204 extend from the bottom of side wall 86 of lid 74. Prongs 202 and 204 have a bent shape, such that leg portion 206 of prong 202, and leg portion 208 of prong 204, extend toward back wall 100 of inner edge 90 (i.e., toward the center of lid 74). The leg portions 206 and 208 are adapted to be received by housing apertures 210 and 212, respectively, which are shown in FIG. 12. Moreover, as shown in FIGS. 15 and 16, a lid extension 214 extends from the bottom of side wall 86 of lid 74, on the opposite side of the lid 84 from the prongs 202, 204. Lid extension 214 includes an extension aperture 216, which is sized and shaped to receive extension locking lug 218. Extension locking lug 218 extends from the outer surface of housing 72 and is shown in FIG. 17, which is a back view of housing 72. Extension locking lug 218 is located on the opposite side of housing 72 from housing apertures 210 and 212. In the embodiment shown, the extension aperture 216 and extension locking lug 218 each have a square shape. However, in other embodiments, different shapes may be used, so long as the extension aperture 216 is adapted to receive the extension locking lug 218.

In order to secure the lid 74 to housing 72, first leg portions 206, 208 of prongs 202, 204 are inserted into housing apertures 210, 212. At that point, the lid 74 is at an angle in relation to the top of housing 72. The side of lid 74 including lid extension 214 is then lowered until extension aperture 216 receives extension locking lug 218 of housing 72. The combination of the connection between prongs 202, 204 and housing apertures 210, 212, and between lid extension 214 and extension locking lug 218, serves to lock the lid 74 onto housing 72. To remove lid 74 from housing 72, lid extension 214 is lifted away from side wall 76 of housing 74, such that lid extension 214 no longer engages extension locking lug 218. Lid extension 214 is sufficiently resilient such that lid extension 214 may be disengaged from extension locking lug 218 in this manner. The side of lid 74 which includes lid extension 214 is then angled upward, away from housing 72, and leg portions 206, 208 of prongs 202, 204 are removed from housing apertures 210, 212.

As shown in FIG. 16, which shows a bottom perspective view of the lid 74, the lid side wall 86 includes a housing locking lug 106 projecting from an interior surface of the lid side wall. As shown in FIG. 17, the side wall 76 of the housing 72 includes a lid locking lug 108 projecting from an exterior surface of the side wall, proximate to the top end 78 of the side wall. The lid 74 may be made from a material that is sufficiently resilient such that when the lid 74 is pushed into place on the top end 78 of the side wall 76, the housing locking lug 106 is able to slide past the lid locking lug 108 and then rest below the lid locking lug. The force of the lid locking lug 108 against the housing locking lug 106 assists in preventing the lid 74 from lifting upward off of the housing 72. However, in some embodiments, the holder 70 may not include a housing locking lug 106 and lid locking lug 108, instead relying on the connection between prongs 202, 204 and housing apertures 210, 212, and between lid extension 214 and extension locking lug 218, to lock the lid 74 onto housing 72. In alternative embodiments, other structures may be used to lock the lid 74 onto housing 72, such as a hinge connecting lid 74 to housing 72.

The lid 74 includes an outer ridge 110 extending outward from the lid side wall 86. The outer ridge 110 facilitates removal of the lid 74 from the housing 72, because a user may exert upward pressure on outer ridge 110 to remove the lid. The user may also exert downward pressure on outer ridge 110 when locking the lid 74 onto the housing 72.

As is the case with the embodiment designated as holder 10, as discussed above, holder 70 is designed to hold a squeeze pouch such as the squeeze pouch 52 depicted in FIG. 7. The manner of inserting the squeeze pouch 52 into holder 70 is analogous to the manner of inserting the squeeze pouch 52 into holder 10, which is discussed above.

Slot 88 of the embodiment shown in FIG. 13 is sized and shaped to allow a spout 56 with flanges 60, 62 to slide through the slot, and to be secured to the lid 74 in the manner that a spout is secured to a lid 14, as discussed above. The configuration of slot 88 is advantageous because it allows a squeeze pouch 52 to be secured to the lid 74 without removing cap 58. Also, after cap 58 is removed, the configuration of slot 88 allows cap 58 to be securely placed back onto the spout 56 without removing the squeeze pouch 52 from holder 70. However, in other embodiments of the present invention, slot 88 may be sized and shaped differently. For example, in some embodiments, the slot may not extend through lid side wall 86, and the slot may be designed to allow a spout 56 to be raised through the slot from below the lid 74. The slot may also be designed to allow lid 74 to be screwed onto a spout 56, in the manner of a screw-top lid. Moreover, in an embodiment in which the lid 74 is made from a resilient or stretchy material, the slot 88 may be designed to hold the spout 56 in the lid through the frictional force caused by the resilience of the lid material. Such alternative designs may be advantageous for holders 70, when used to contain squeeze pouches 52 which do not have spouts 56 including flanges 60, 62.

The holder 70 may be constructed from a variety of materials, such as but not limited to plastic or silicone materials. For example, the holder 70 may be made from a shatterproof, dishwasher-safe, substantially rigid plastic. The plastic may be sufficiently rigid such that if a child eating from a squeeze pouch exerts pressure on the side wall 76 of the housing 72, the side wall 76 will not become indented to the extent that pressure is placed on the pouch 54. Also, the plastic may be sufficiently rigid such that if a child sits on or steps on a holder 70 containing a squeeze pouch 52, the side wall 76 will not become indented to the extent that pressure is placed on the pouch 54. This rigidity is advantageous because if pressure is placed on the pouch 54 of a squeeze pouch 52 containing food, the pressure may cause food to exit the spout 56. In some embodiments, the holder 70, or at least the housing 72, may be constructed from a transparent plastic. A transparent housing would allow a user to see whether any food or beverage is left in the squeeze pouch 52, without the need to look at the pouch 54 through the bottom of the housing 72.

Figure 18:
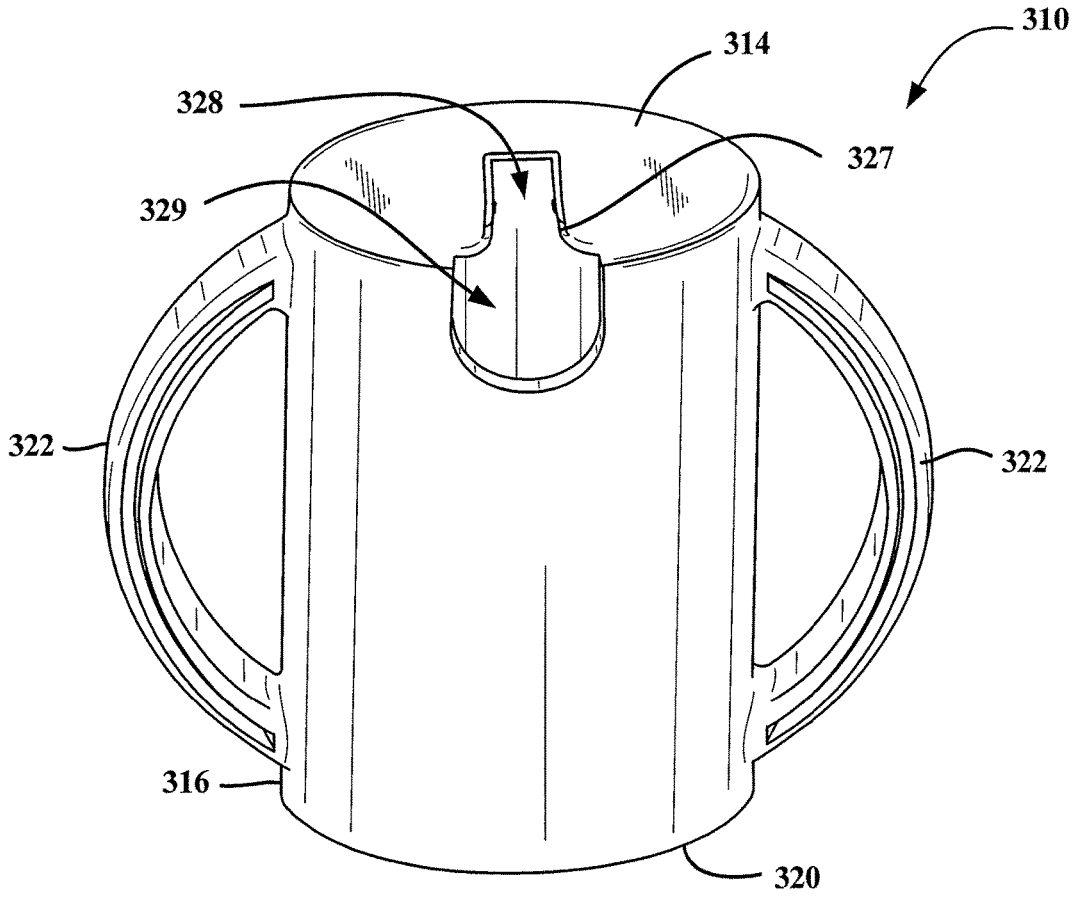
FIG. 18 is a perspective view of a fifth embodiment of the holder of the present invention.

In an alternative embodiment, the holder may have a one-piece construction, instead of including a lid which is separate from the holder. An example of an embodiment of a holder having a one-piece construction is shown in FIG. 18. As shown in FIG. 18, the holder 310 includes a top wall 314 and a side wall 316. The holder 310 includes a base 320 opposite to the top wall 314. In the embodiments shown in the figures, the holder 310 has a cylindrical shape with an elliptical cross-section, and therefore only includes one side wall 316. However, in alternative embodiments, the holder 310 may have different shapes, such as a rectangular prismatic shape including four side walls, or a triangular prismatic shape including three side walls. The holder 310 may also have a shape similar to a cylinder or an elliptical cylinder, but with a cross-section including corners, such that the holder 310 includes more than one side wall.

Handles 322 extend from the exterior surface of the side wall 316. The holder 310 depicted in FIG. 18 includes two handles 322, but other embodiments may have a greater or lesser number of handles, or may have no handles. In the embodiments shown in the figures, each handle 322 is attached to side wall 316 at both ends of the handle, and there are no gaps in the handle. In other words, each handle 322 has a closed design. The closed design of handle 322 is advantageous because it allows an attachment device such as a clip, ring, or cord to be attached to the handle, without sliding off of an end of the handle or sliding through a gap in the handle. A cord may be attached directly to handle 322, or a cord may be attached to the handle through a clip, ring, or the like. Attaching a cord to handle 322 allows the holder 310 to be tethered or clipped to an object such as a stroller, playpen, or crib, so that a child cannot throw the holder onto the ground and/or lose the holder. The holder 310 may also be tethered or clipped to a jacket or other clothing, so that a child cannot throw the holder and/or lose the holder. However, although there are advantages to the design of handle 322 shown in FIG. 1, other embodiments of the invention may include handles having different shapes and designs, including a design in which an end of the handle is not attached to side wall 316, or a design including a gap in the handle. A ring or other attachment device may be permanently affixed to a point on the handle or elsewhere on the holder, so that, even in an embodiment in which the handle does not have a closed design as shown in FIG. 18, attaching a cord to the holder may still be possible.

Figure 19:
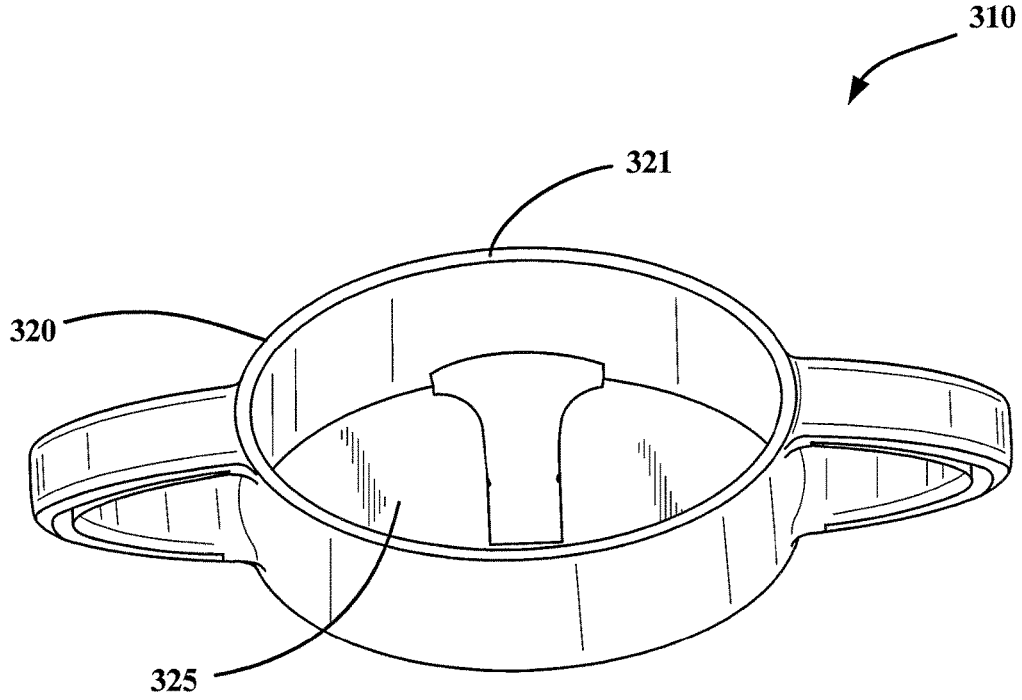
FIG. 19 is a bottom perspective view of the holder of FIG. 18.

FIG. 19 is a bottom perspective view of the holder 310. As shown in FIG. 19, the base 320 of holder 310 comprises a bottom edge 321 and a base aperture 325. Therefore, when the holder 310 is placed upright on a flat surface, only the bottom edge 321 contacts the surface. In this embodiment, the bottom edge 321 defines the edge of base aperture 325. The pouch 54 of squeeze pouch 52 may be accessed through the base aperture 325 of the holder 310, without removing the squeeze pouch from the holder. This may be useful so that a user may check to see whether any food or beverage is left in the pouch 54. Also, sometimes it may be necessary to press on the pouch 54 in order to squeeze food up from the bottom of the pouch 54 toward the top. The lack of a bottom wall allows pouch 54 to be accessed easily. However, in some embodiments of the present invention, the base 320 of holder 310 includes a bottom wall, analogous to bottom wall 23 of FIG. 3. In such embodiments, the bottom wall may include an opening, or base aperture 325, such that the interior of the holder 310 may be accessed through the base 320, via base aperture 325, despite the presence of a bottom wall. The bottom wall may also be removable, as lid 14 or lid 74, discussed above, are removable from housing 12 and housing 72 respectively. The bottom wall may then be secured to the bottom end of holder 310, in a manner similar to the way in which lid 14 is secured to top end 18 of the housing 12, or the way in which lid 74 is secured to top end 78 of the housing 72. Alternatively, the bottom wall of holder 310 may be made from a resilient or stretchy material which stretches over the bottom end of the holder. In an embodiment with a removable bottom wall, the bottom wall may be placed on holder 310 in order to protect the pouch 54 from all sides after the squeeze pouch 52 is secured in the holder. The bottom wall may later be removed in order to view or access the pouch.

Figure 20:
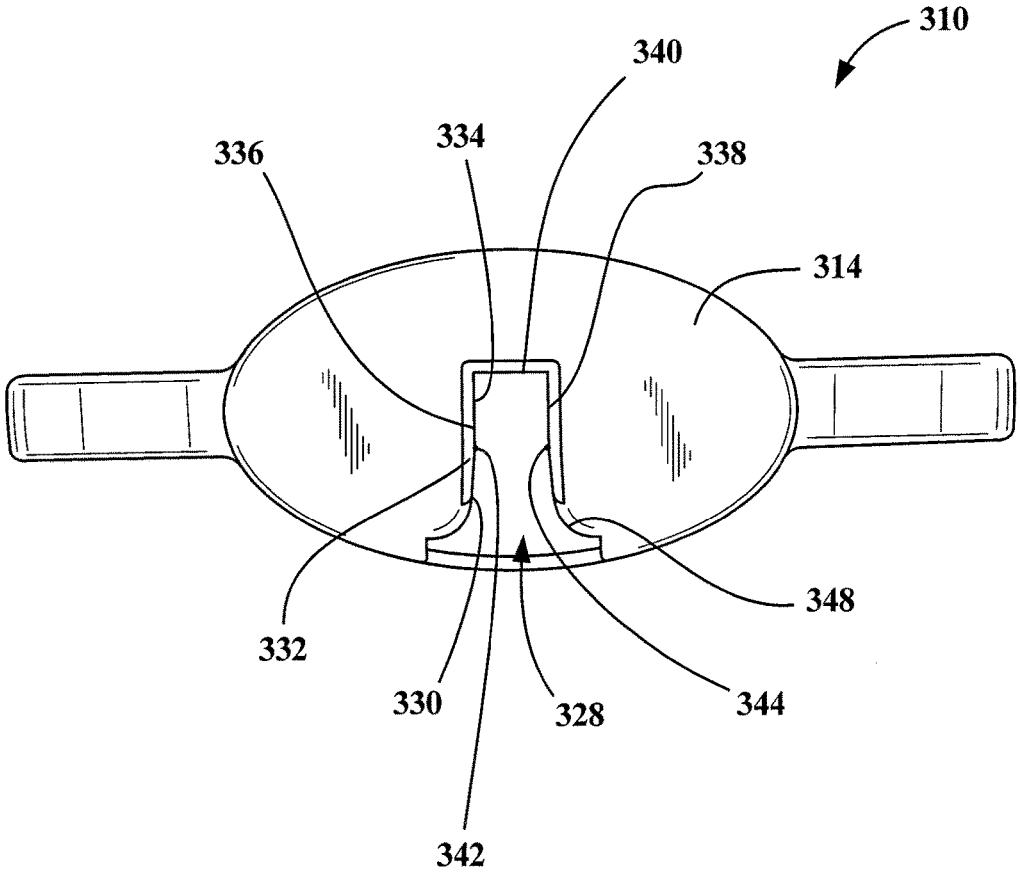
FIG. 20 is a top view of the holder of FIG. 18.

FIG. 20 is a top view of the holder 310, showing top wall 314. The top wall 314 includes a slot 328, which is contiguous with an aperture 329 in side wall 316 (see FIG. 18), such that slot 328 and aperture 329 form one opening 327 in the holder 310 which extends through both top wall 314 and side wall 316. The slot 328 includes an inner edge 330.

Figure 21:
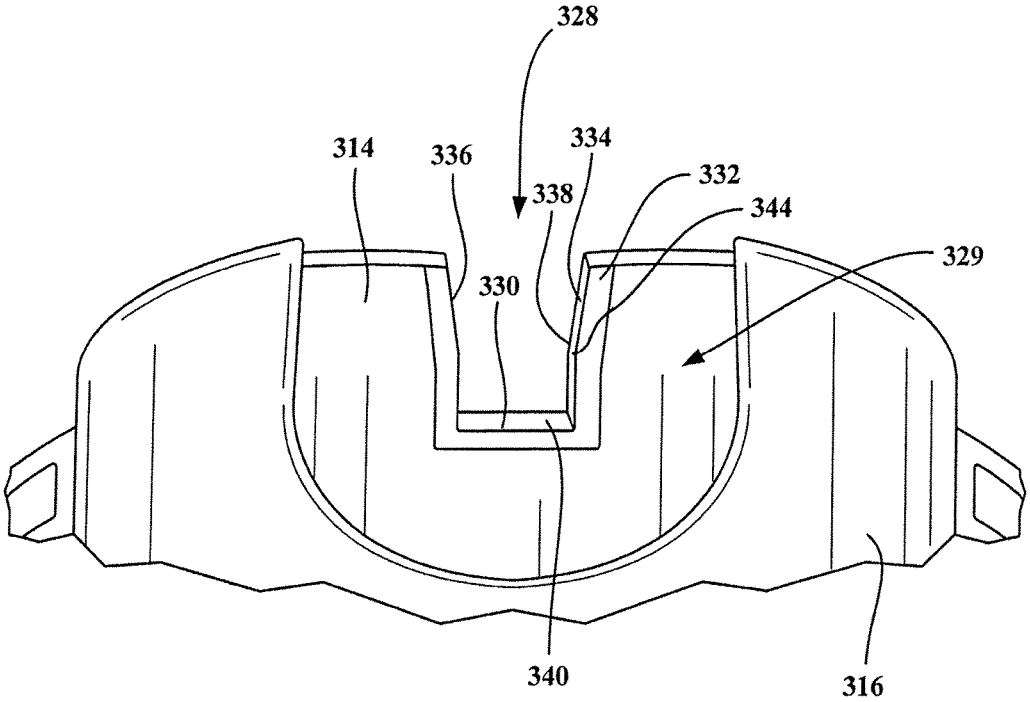
FIG. 21 is a top perspective view of a portion of a sixth embodiment of the holder of the present invention.

In the embodiment shown in FIG. 20, a ridge 332 extends from the top surface 331 of the top wall 314, proximate to the slot 328. In an alternative embodiment shown in FIG. 21, the ridge 332 extends from the bottom surface 333 of the top wall 314, proximate to the slot 328. The embodiment in FIG. 21 is easier to manufacture because the top surface 331 is flat, and therefore requires less pieces for injection molding. Because of the flat top surface 331, the embodiment of FIG. 21 is also easier to clean. With regard to the embodiment in FIG. 20, the interior portion 334 of the ridge 332 forms part of the inner edge 330 of the top wall 314. With regard to the embodiment in FIG. 21, the interior portion 334 of the ridge 332 forms inner edge 330 of the top wall 314. The inner edge 330 includes a first wall 336, a second wall 338, and a back wall 340, wherein the first wall 336 is opposite the second wall 338, and the back wall 340 extends between the first wall 336 and the second wall 338. A first projection 342 extends inwardly from the first wall 336 of the inner edge 330, while a second projection 344 extends inwardly from the second wall 338, toward projection 342.

Although the top wall 314 of FIGS. 20 and 21 is described in the context of a holder 310 with a one-piece construction, in alternative embodiments, the design of the top wall 314 and slot 328 may be used in conjunction with a detachable top wall or lid. In other words, the design of top wall 314 may be used as the top wall 24 of lid 14, of holder 10 described above, or as the top wall 84 of lid 74, of holder 70 described above.

Figure 22:
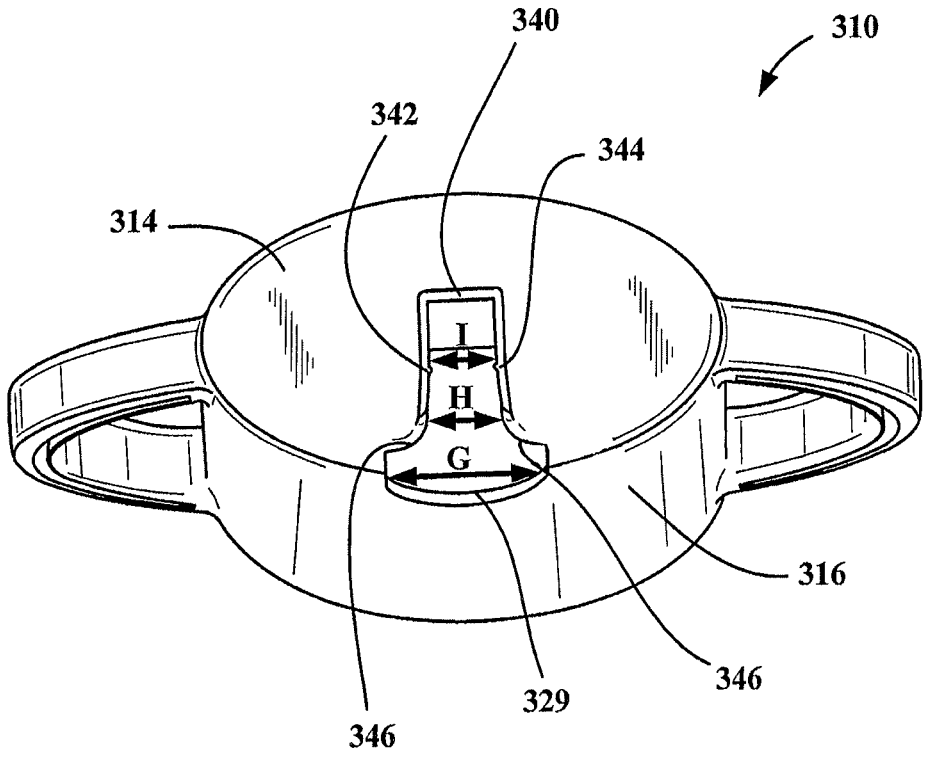
FIG. 22 is a top perspective view of the holder of FIG. 18.

In the embodiments shown in the figures, the width of the aperture 329, at its widest point, is greater than the width of the slot 328 along most of the length of the slot. The width of the aperture 329 at its widest point, or the "aperture width," is represented by distance G in FIG. 22. Also, the width of slot 328 proximate to the side wall 316 is greater than the width of slot 328 near the center of the top wall 314. The width of the slot 328 proximate to the side wall 316, or the "side wall slot width," is represented by distance H in FIG. 22. As the slot 328 extends from the side wall 316 toward the center of the top wall 314, the slot has a width which tapers inwardly from points 346 near the side wall 316 to projections 342, 344. In other words, a portion of the slot 328 tapers inwardly as it extends from the side wall 316 toward the center of the top wall 314. The width of the slot 328 is then substantially constant from the projections 342, 344 to the back wall 340. As shown in FIG. 22, the width of the slot 328 at any location from points 346 to the back wall 340, such as the width depicted as distance I, is less than the side wall slot width H and the aperture width G. However, the slot 328 may have various different shapes or configurations. For example, the inner edge 330 in the embodiment shown in FIG. 20 includes a curved portion 348, while the inner edge 330 in the embodiment shown in FIG. 21 does not.

As is the case with the embodiment designated as holder 10, as discussed above, holder 310 is designed to hold a squeeze pouch such as the squeeze pouch 52 depicted in FIG. 7. The squeeze pouch 52 may be inserted into the holder 310 through the bottom end 320. The cap 58 may then be extended through aperture 329. The spout 56 may then be slid into the slot 328 of the top wall 314, as discussed below. Alternatively, in some embodiments, aperture 329 may be large enough to allow pouch 54 of the squeeze pouch 52 to be inserted into the holder 310 through aperture 329, rather than through bottom end 320. The spout 56 may then be slid into the slot 328 of the top wall 314.

Figure 23:
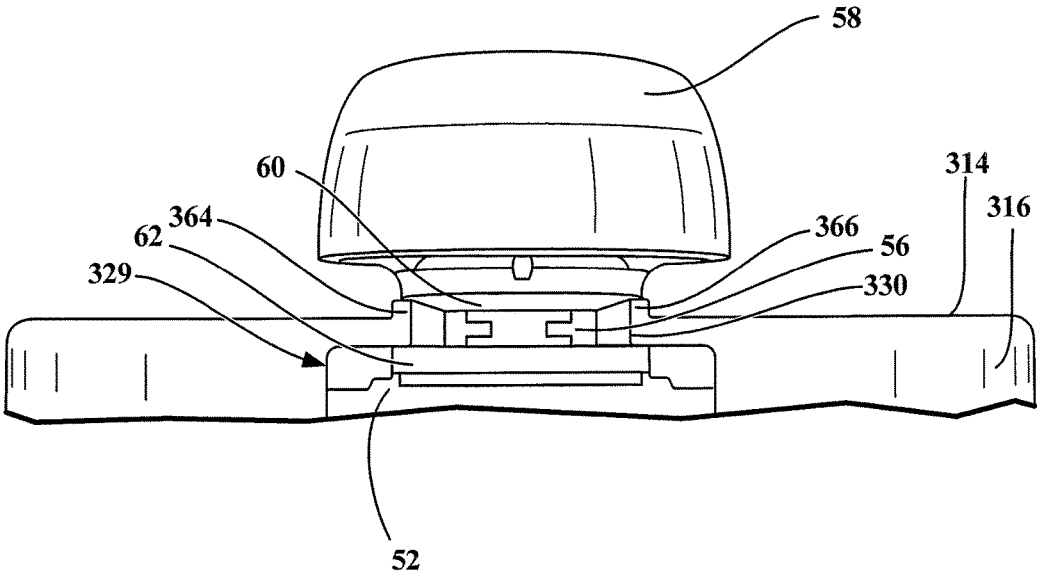
FIG. 23 is a side view of a the top wall of the holder of FIG. 18 holding the squeeze pouch of FIG. 7.

The slot 328 of the top wall 314 is adapted to receive the spout 56 of the squeeze pouch 52 such that the top wall 314 is able to securely hold the spout 56, as shown in FIG. 23. To secure the spout 56 in the top wall 314, the user aligns the spout 56 with the inner edge 330 of the top wall 314 such that the front surface 364 of first wall 336, and the front surface 366 of second wall 338, is placed between the upper flange 60 and lower flange 62 of the spout 56. Once the spout 56 is aligned with the inner edge 330, the spout 56 is pushed through slot 328, toward the center of top wall 314. The spout 56 is pushed past projections 342 and 344, until the spout 56 is located with the projections 342 and 344 in front of the spout, and the back wall 340 of inner edge 330 in back of the spout. The first wall 336, second wall 338, and back wall 340 of the inner edge 330 may each be in contact with the spout 56 when the spout is secured to top wall 314, or there may be a space between any or all of walls 336, 338, 340 and the spout 56.

The projections 342 and 344 lock the spout 56 in place such that the spout cannot be removed from the top wall 314 without the application of force. The ridge 332 provides added stability, because the ridge allows the inner edge 330 of top wall 314 to be sized to fit securely between the upper flange 60 and lower flange 62 of a typical squeeze pouch. Also, because the width of slot 328 tapers inwardly as the slot passes through the top wall 314, the slot 328 is able to be sufficiently narrow behind projections 342 and 344 to hold the spout 56 securely. However, because the width of slot 328 is wider proximate to the side wall 316, it is easier to pass the spout 56 through the slot 328 than it would be if the slot was narrow along its entire length. The aperture width G (see FIG. 22) is greater than the width of the slot 328 along most of its length, in order to allow at least the cap 58 of the squeeze pouch 52 to pass through the aperture 329.

Slot 328 of the embodiment shown in FIG. 20 is sized and shaped to allow a spout 56 with flanges 60, 62 to slide through the slot, and to be secured to the top wall 314 as described above. The configuration of slot 28 is advantageous because it allows a squeeze pouch 52 to be secured to the top wall 314 without removing cap 58. Also, after cap 58 is removed, the configuration of slot 28 allows cap 58 to be securely placed back onto the spout 56 without removing the squeeze pouch 52 from holder 310. However, in other embodiments of the present invention, slot 328, or the entire opening 327 including both the slot 328 and aperture 329, may be sized and shaped differently. For example, in some embodiments, the slot 328 may not be contiguous with an aperture 329, and the slot may be designed to allow a spout 56 to be raised through the slot from below the top wall 314. The slot may also be designed to allow a detachable top wall 314 to be screwed onto a spout 56, in the manner of a screw-top lid. Moreover, in an embodiment in which the top wall 314 is made from a resilient or stretchy material, the slot 328 may be designed to hold the spout 56 in the lid through the frictional force caused by the resilience of the lid material. Such alternative designs may be advantageous for holders 310, when used to contain squeeze pouches 52 which do not have spouts 56 including flanges 60, 62.

Once the spout 56 is secured in the top wall 314, the holder 310 contains the squeeze pouch 52, just as the holder 10 contains the squeeze pouch 52 in FIG. 9. Due to the design of the holder 310, the spout 56 of the squeeze pouch 52 may be secured to the top wall 314, as discussed above, without removing the cap 58. This is advantageous because once the cap is removed from many squeeze pouches containing foods or beverages, the squeeze pouches must then be refrigerated. Therefore, if the cap 58 needed to be removed from squeeze pouch 52 prior to securing the spout 56 to top wall 314, the food or beverage in the squeeze pouch 52 would either need to be refrigerated or consumed immediately after the squeeze pouch was secured in the holder 310. However, because the embodiments shown in the figures allow the cap 58 to remain on the squeeze pouch 52 when it is placed in the holder 310, the squeeze pouch 52 may be placed in the holder 310 well before the food or beverage in the squeeze pouch is consumed. This is useful in situations such as car trips with children, because a parent may place a squeeze pouch in the holder before beginning the car trip. Then, if a child becomes hungry during the trip, the parent may give the holder containing the squeeze pouch to the child, without stopping to place the squeeze pouch in the holder.

The holder 310 may be constructed from a variety of materials, such as but not limited to plastic or silicone materials. For example, the holder 310 may be made from a shatterproof, dishwasher-safe, substantially rigid plastic. The plastic may be sufficiently rigid such that if a child eating from a squeeze pouch exerts pressure on the side wall 316, the side wall will not become indented to the extent that pressure is placed on the pouch 54. Also, the plastic may be sufficiently rigid such that if a child sits on or steps on a holder 310 containing a squeeze pouch 52, the side wall 316 will not become indented to the extent that pressure is placed on the pouch 54. This rigidity is advantageous because if pressure is placed on the pouch 54 of a squeeze pouch 52 containing food, the pressure may cause food to exit the spout 56. In some embodiments, the holder 310, or at least a portion of the holder 310 (such as the side wall 316) may be constructed from a transparent plastic. A transparent holder 310, or a holder 310 with a sufficiently large transparent portion, would allow a user to see whether any food or beverage is left in the squeeze pouch 52, without the need to look at the pouch 54 through the bottom end 320 of the holder.

The holder of the present invention may be made in a variety of shapes and dimensions which accommodate squeeze pouches. However, in one embodiment, the dimensions are approximately as follows. The height of the holder 310 is approximately 5.5 inches. The width of the holder 310 is approximately 3.25 inches at its widest width, and approximately 1.75 inches at its narrowest width. The aperture width G is between approximately 1.0 inch and 1.75 inches. The width of the slot 328 at the back wall 340 is between approximately 0.25 inch and 0.5 inch. The height of the inner edge 330 is approximately 0.125 inch.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A holder for a squeeze pouch including a flexible portion containing a food or beverage, the holder comprising:

one single continuous side wall including an aperture, wherein the side wall surrounds a circumference of the flexible portion of the squeeze pouch when the squeeze pouch is contained in the holder to protect the flexible portion of the squeeze pouch from pressure;

a top wall including a slot contiguous with the aperture, wherein the slot is adapted to receive a spout of the squeeze pouch, said top wall having an inner edge which defines a boundary of the slot, wherein the inner edge of the top wall comprises a first wall, a second wall opposite to the first wall, and a back wall extending between the first wall and the second wall, and wherein a portion of the slot has a substantially constant width; and a base comprising a base aperture, wherein the base aperture is adapted to allow the squeeze pouch to be fully inserted into the holder through the base aperture before the food or beverage in the squeeze pouch is consumed, such that the spout of the squeeze pouch may be received by the slot of the top wall;

wherein a length of the aperture is less than half of a length of the side wall from the top wall to the base.

2. The holder of claim 1, wherein at least a portion of the slot tapers inwardly as it extends from the side wall toward the center of the top wall.

3. The holder of claim 1, further comprising a handle extending from an exterior surface of the side wall.

4. The holder of claim 1, the aperture having an aperture width at a widest point of the aperture, wherein the aperture width is greater than a width of the slot.

5. The holder of claim 1, wherein the holder is substantially rigid.

6. The holder of claim 1, wherein the holder has a one-piece construction.

7. The holder of claim 1, further comprising a removable bottom wall adapted to be secured to the base of the holder.

8. The holder of claim 1, wherein an aperture width is between approximately 1.0 inches and 1.75 inches.

9. The holder of claim 1, wherein a ratio of a width of the slot at the back wall to a widest width of the holder is in a range from approximately 1:13 to 2:13.

10. The holder of claim 1, wherein a first projection extends inwardly from the first wall of the inner edge, and a second projection extends inwardly from the second wall of the inner edge toward the first projection.

11. A holder for a squeeze pouch including a flexible portion containing a food or beverage, the holder comprising:

a housing comprising one single continuous side wall, wherein the side wall surrounds a circumference of the flexible portion of the squeeze pouch when the squeeze pouch is contained in the holder to protect the flexible portion of the squeeze pouch from pressure, said housing having a top end and a base, the base comprising a base aperture, wherein the base aperture is adapted to allow the squeeze pouch to be fully inserted into the holder through the base aperture before the food or beverage in the squeeze pouch is consumed; and a lid adapted to engage the top end of the housing, said lid having a top wall, a lid side wall, and a slot, said slot extending through the lid side wall and into the top wall, wherein the slot is adapted to receive a spout of the squeeze pouch, and wherein the top wall includes an inner edge which defines a boundary of a portion of the slot, wherein the inner edge of the top wall comprises a first wall, a second wall opposite to the first wall, and a back wall extending between the first wall and the second wall, and wherein a portion of the slot has a substantially constant width.

12. The holder of claim 11, wherein at least a portion of the slot tapers inwardly as it extends from the lid side wall toward the center of the top wall.

13. The holder of claim 11, further comprising a handle extending from an exterior surface of the side wall.

14. The holder of claim 11, the slot having a lid side wall slot width and a top wall slot width, wherein the lid side wall slot width is greater than the top wall slot width.

15. The holder of claim 11, further comprising a first prong and a second prong extending from the lid, wherein the housing further comprises a first housing aperture adapted to receive the first prong and a second housing aperture adapted to receive the second prong.

16. The holder of claim 15, further comprising:

a locking lug extending from an exterior surface of the side wall; and a lid extension extending from the lid including an extension aperture adapted to receive the locking lug.

17. The holder of claim 11, further comprising a removable bottom wall adapted to be secured to the base of the housing.

18. The holder of claim 11, wherein a ratio of a width of the slot at the back wall to a widest width of the housing is in a range from approximately 1:13 to 2:13.

19. The holder of claim 11, wherein a first projection extends inwardly from the first wall of the inner edge, and a second projection extends inwardly from the second wall of the inner edge toward the first projection.

* * * * *